US006140891A

United States Patent [19]

Nakakubo et al.

[11] Patent Number: 6,140,891

[45] Date of Patent: Oct. 31, 2000

[54] DIELECTRIC LAMINATED FILTER

[75] Inventors: Hideaki Nakakubo, Kyoto; Toshio Ishizaki, Kobe; Toru Yamada, Katano; Shoichi Kitazawa, Nishinomiya; Hiroshi Kushitani, Izumisano, all of Japan

[73] Assignee: Matsushita Electric Industrial Co., Ltd., Osaka, Japan

[21] Appl. No.: 08/954,381

[22] Filed: Oct. 20, 1997

[30] Foreign Application Priority Data

Oct. 18, 1996 [JP] Japan ..... 8-276102

[51] Int. Cl.[7] ..... H01P 1/203

[52] U.S. Cl. ..... 333/204; 333/205

[58] Field of Search ..... 333/204, 205, 333/219, 246

[56] References Cited

U.S. PATENT DOCUMENTS

| | | | |
|---|---|---|---|
| 5,191,304 | 3/1993 | Jachowski | 333/202 |
| 5,248,949 | 9/1993 | Eguchi et al. | 333/246 X |
| 5,448,209 | 9/1995 | Hirai et al. | 333/204 |
| 5,479,141 | 12/1995 | Ishizaki et al. | 333/204 |
| 5,770,986 | 6/1998 | Tonegawa et al. | 333/204 |

FOREIGN PATENT DOCUMENTS

| | | | |
|---|---|---|---|
| 5-218705 | 8/1993 | Japan . | |
| 5-243812 | 9/1993 | Japan . | |
| 6-45803 | 2/1994 | Japan | 333/204 |
| 6-97705 | 4/1994 | Japan | 333/204 |
| 6-268410 | 9/1994 | Japan . | |
| 6-268411 | 9/1994 | Japan . | |

*Primary Examiner*—Seungsook Ham
*Attorney, Agent, or Firm*—Ratner & Prestia

[57] ABSTRACT

A dielectric laminated filter has a first dielectric laminated block including a first strip line electrode and a second dielectric laminated block including a second strip line electrode and a coupling element, wherein the first and the second dielectric laminated blocks are laminated via a first shield electrode and wherein the first and the second strip lines are connected via a third strip line. This configuration allows the unwanted electromagnetic coupling between a resonator and the coupling element to be neglected, and uses the third strip line electrode to form the first and the second strip line electrodes so that they extend across different layers, thereby enabling the size of the resonator to be reduced. In addition, since the third strip line electrode serves to adjust the filter characteristics, a small high-performance dielectric laminated filter that can be designed easily can be provided.

18 Claims, 21 Drawing Sheets

DIELECTRIC LAMINATED FILTER

BACKGROUND OF THE INVENTION

1. Field of the Invention

The present invention relates to a small dielectric laminated filter mainly used for a high frequency radio apparatus such as a portable telephone and a communication apparatus.

2. Related Art of the Invention

In recent years, many dielectric laminated filters have been used as high frequency filters for portable telephones. There is, however, a demand for further reduction of the size and thickness of such filters and attention is being paid to planar dielectric laminated filters that can be made thinner than a coaxial type.

An example of the above conventional dielectric laminated filter is described with reference to the drawings.

FIG. 13 shows an exploded perspective view of a conventional dielectric laminated filter. FIG. 14 shows a laminated body constituted by laminating the layers shown in FIG. 13 which are dissembled, as seen from the direction shown by arrow A. FIG. 15 is a cutaway cross sectional view in which the filter is cut along line D-D' shown in FIG. 13.

In FIGS. 13, 14, and 15, reference numerals 101, 102, 103, 104, 105, 106, and 107 designate dielectric sheets. Reference numerals 108*a* and 108*b* designate strip line electrodes formed on a dielectric sheet 105. Reference numerals 109*a* and 109*b* denote I/O line electrodes, 110*a* and 110*b* are notch capacity electrodes, 111 is a coupling line electrode, and these inner electrodes are formed on the dielectric sheets 106, 104, and 102, respectively.

These dielectric sheets are laminated to form a dielectric laminated block on which shield electrodes 115 and 116 are formed on its top and bottom surfaces, respectively. I/O electrodes 117*a* and 117*b* and a ground electrode 118 are formed on the outer circumferential side of the dielectric laminated block.

The effects of the dielectric laminated filter configured as described above are described.

In the dielectric laminated filter shown in FIG. 13, the shield electrodes 115 and 116 are grounded via the ground electrode 118. In addition, one end of each of the strip line electrodes 108*a* and 108*b* is grounded via the ground electrode 118 to constitute quarter-wavelength strip line resonators. The coupling line electrode 111 and the I/O line electrodes 109*a* and 109*b* act as a distributed constant line. A notch capacity is provided between the notch capacity electrode 110*a* or 110*b* and the strip line electrode 108*a* or 108*b*. The notch capacity electrodes 110*a* and 110*b* are connected together via the coupling line electrode 111 to connect the two strip line resonators in parallel via the notch capacity, and one end of the I/O line electrodes 109*a* and 109*b* are connected to the notch capacity electrodes 110*a* and 110*b* with the other ends connected to the I/O electrodes 117*a* and 117*b* in order to constitute a band elimination filter.

To prevent the electromagnetic coupling between the respective electrodes, for example, between the strip line electrodes 108*a* and 108*b*, earth electrodes 112, 113, and 114 are formed between the strip line electrodes 108*a* and 108*b*, between the I/O line electrodes 109*a* and 109*b*, and between the notch capacity electrodes 110*a* and 110*b*, respectively.

To prevent the electromagnetic coupling between the strip line electrodes 108*a* and 108*b* and the coupling line electrode 111, a shield electrode 120 is formed on the dielectric sheet 103.

A dielectric laminated filter of this configuration is shown in, for example, Japanese Patent Application Laid-Open No. 6-268410.

This design, however, is complicated in this configuration because the electromagnetic coupling between the I/O line 109*a* or 109*b* and the strip line 108*a* or 108*b* cannot be prevented.

In addition, if dielectric sheets with a large dielectric constant to reduce the size of the filter are used, the electromagnetic coupling between the I/O and the coupling lines and the strip lines is further increased, thereby preventing a good band elimination filter characteristic from being obtained.

Furthermore, the conventional prevention of the electromagnetic coupling between the strip lines 108*a* and 108*b* using the earth electrode 112, the electromagnetic coupling between the notch capacity electrodes 110*a* and 110*b* using the earth electrode 113, and the electromagnetic coupling between the I/O lines 109*a* and 109*b* using the earth electrode 114 is all imperfect and inductance is in fact provided in the earth electrodes 112, 113, and 114. Thus, unwanted electromagnetic coupling occurs between the strip line electrodes 108*a* and 108*b* and the earth electrode 112, between the I/O line electrodes 109*a* and 109*b* and the earth electrode 113, and between the notch capacity electrodes 110*a* and 110*b* and the earth electrode 114.

Furthermore, the earth electrodes 112, 113, and 114 disturb the distribution of electromagnetic fields from the strip line electrodes 108*a* and 108*b*, the I/O line electrodes 109*a* and 109*b*, and the notch capacity electrodes 110*a* and 110*b* to degrade the unloaded Q. As a result, a good band elimination filter characteristic cannot be achieved easily.

SUMMARY OF THE INVENTION

In view of these problems of the conventional dielectric laminated filters, it is an object of this invention to provide a dielectric laminated filter and a communication apparatus that can achieve a much better band elimination filter characteristic compared to the prior art.

To attain the object, a dielectric laminated filter of the first invention comprises a first dielectric laminated block in which a plurality of dielectric sheets are laminated; a plurality of first resonance electrodes formed on an inner layer of said first dielectric laminated block; a second dielectric laminated block in which a plurality of dielectric sheets are laminated; a plurality of second resonance electrodes formed on an inner layer of said second dielectric laminated block; a coupling element formed on an inner layer of said second dielectric laminated block to connect said plurality of second resonance electrodes in parallel; a first shield electrode formed between said first dielectric laminated block and said second dielectric laminated block; a plurality of third resonance electrodes formed on an outer side to connect one end of each of said first resonance electrodes to one end of each of said second resonance electrodes; a second shield electrode formed opposite to one surface of said first shield electrode; a third shield electrode formed opposite to the other surface of said first shield electrode; and a connection electrode formed on an outer side to connect said first, second, and third electrodes together.

According to this dielectric laminated filter, for example, a first and a second dielectric laminated blocks can be laminated via the shield electrodes to eliminate the unwanted electromagnetic coupling between strip line resonators and a coupling element, thereby enabling easy design. This filter can also provide a good band elimination filter characteristic to increase the degree of freedom for design and can be made smaller by increasing the dielectric constant of dielectric sheets.

In addition, by, for example, connecting first, second, and third resonance electrodes together to form resonators, the wavelength can be increased without increasing the size of the laminated body, so the size of the resonators and thus the filter can be reduced.

Furthermore, by, for example, forming the third resonance electrodes of outer electrodes, the filter characteristics can be adjusted.

A dielectric laminated filter of the second invention according to said first invention has said connection electrode which has a plurality of electrodes that are each formed on either of a pair of opposite surfaces among the outer surfaces and wherein said electrode is formed in an area other than the center of the surface.

The dielectric laminated filter can, for example, provide the same potential between shield electrodes and maintain a constant potential distribution within each shield electrode, thereby providing stable filter characteristics with excellent shielding.

A dielectric laminated filter of the third invention according to said first invention has a shield electrode which is formed all over all the outer sides of said first dielectric laminated block other than the one on which said third resonance electrode is formed.

The dielectric laminated filter can, for example, improve the shielding of the first resonance electrodes with a large magnetic density to reduce radiation losses.

A dielectric laminated filter of the fourth invention according to said first invention includes an outer dielectric sheet laminated on an outer surface of said second shield electrode, wherein one end of said third resonance electrode which extends up to the top surface of said outer dielectric sheet.

The dielectric laminated filter can, for example, form ground capacities between the third resonance electrodes and the second shield electrodes to reduce the wavelength of the resonators.

In addition, by, for example, trimming the third resonance electrodes formed on the upper surface of the laminated body, the ground capacity can be varied to adjust the resonance frequency of the resonators. That is, this filter can absorb the dispersion of dielectric sheets and electrode patterns.

A dielectric laminated filter of the fifth invention according to said first invention has said second resonance electrode which has a larger width than said first resonance electrode.

A dielectric laminated filter of the sixth invention according to said first invention has said first and second dielectric blocks which have different thicknesses.

The dielectric laminated filter can, for example, abruptly vary like a step the impedance of the resonators, that is, can constitute SIR resonators to reduce the resonance frequency and thus the length of the resonators.

A dielectric laminated filter of the seventh invention according to said first invention has said first and second dielectric blocks which are formed of said dielectric sheets of different dielectric constants.

According to this dielectric laminated filter, for example, a first dielectric laminated block can comprise a material with a low dielectric constant while a second dielectric laminated block can comprise a material with a high dielectric constant in order to further reduce the unwanted coupling between the resonators and the coupling element without increasing their sizes.

In addition, this filter enables dielectric sheets with different materials to be laminated via the shield electrodes to reduce changes in material due to the chemical coupling between the different materials. Thus, it enables different materials to be laminated easily, compared to the prior art.

A dielectric laminated filter of the eighth invention according to said first invention includes open stubs connected to said coupling element in parallel to attenuate high-order harmonic bands.

The dielectric laminated filter can have built-in LPF (Low Pass Filter) functions to reduce the size of the multi-functional filter and to reduce losses.

A dielectric laminated filter of the ninth invention comprises a dielectric laminated block in which a plurality of dielectric sheets are laminated; a plurality of resonance electrodes formed on an inner layer of said dielectric laminated block; a coupling line formed on an inner layer of said dielectric laminated block to connect each of said plurality of resonance electrodes in parallel; an I/O line formed on an inner layer of said dielectric laminated block; and a shield electrode that separates said plurality of resonance electrodes from said I/O line.

By separating resonance electrodes from I/O lines using the shield electrodes, the dielectric laminated filter can prevent the electromagnetic coupling between the resonance electrodes and the I/O lines, thereby enabling easy design. This filter can also provide a good band elimination filter characteristic to increase the degree of freedom for design and can be made smaller by increasing the dielectric constant of the dielectric sheets.

A dielectric laminated filter of the tenth invention comprises a dielectric laminated block in which a plurality of dielectric sheets are laminated; a plurality of resonance electrodes formed on an inner layer of said dielectric laminated block and electromagnetically coupled together; and a coupling line formed on an inner layer of said dielectric laminated block to connect each of said plurality of resonance electrodes in parallel, wherein the dielectric laminated filter uses electromagnetic coupling occurring between said plurality of resonance electrodes instead of providing an electromagnetic coupling prevention member for substantially preventing said electromagnetic coupling.

The dielectric laminated filter can, for example, appropriately combine the electromagnetic coupling between the resonators with the coupling line electrode to achieve elliptic function characteristics in order to make the attenuation curve steeper compared to Chebyshev's characteristics that do not use the electromagnetic coupling between the resonators. Although insertion losses in the specific attenuation band would be decreased, insertion losses in the pass band could be further improved. Thus, the attenuation band can be increased without providing a multi-stage filter, thereby reducing the size of the filter and thus losses (improving the performance).

A communication apparatus of the present invention comprises a signal processing means using the dielectric laminated filter according to any of the present inventions; and an output means for outputting said processed signal.

DESCRIPTION OF THE PREFERRED EMBODIMENTS

The dielectric laminated filters according to the embodiments of this invention are described below with reference to the drawings.

(Embodiment 1)

Figure 1:
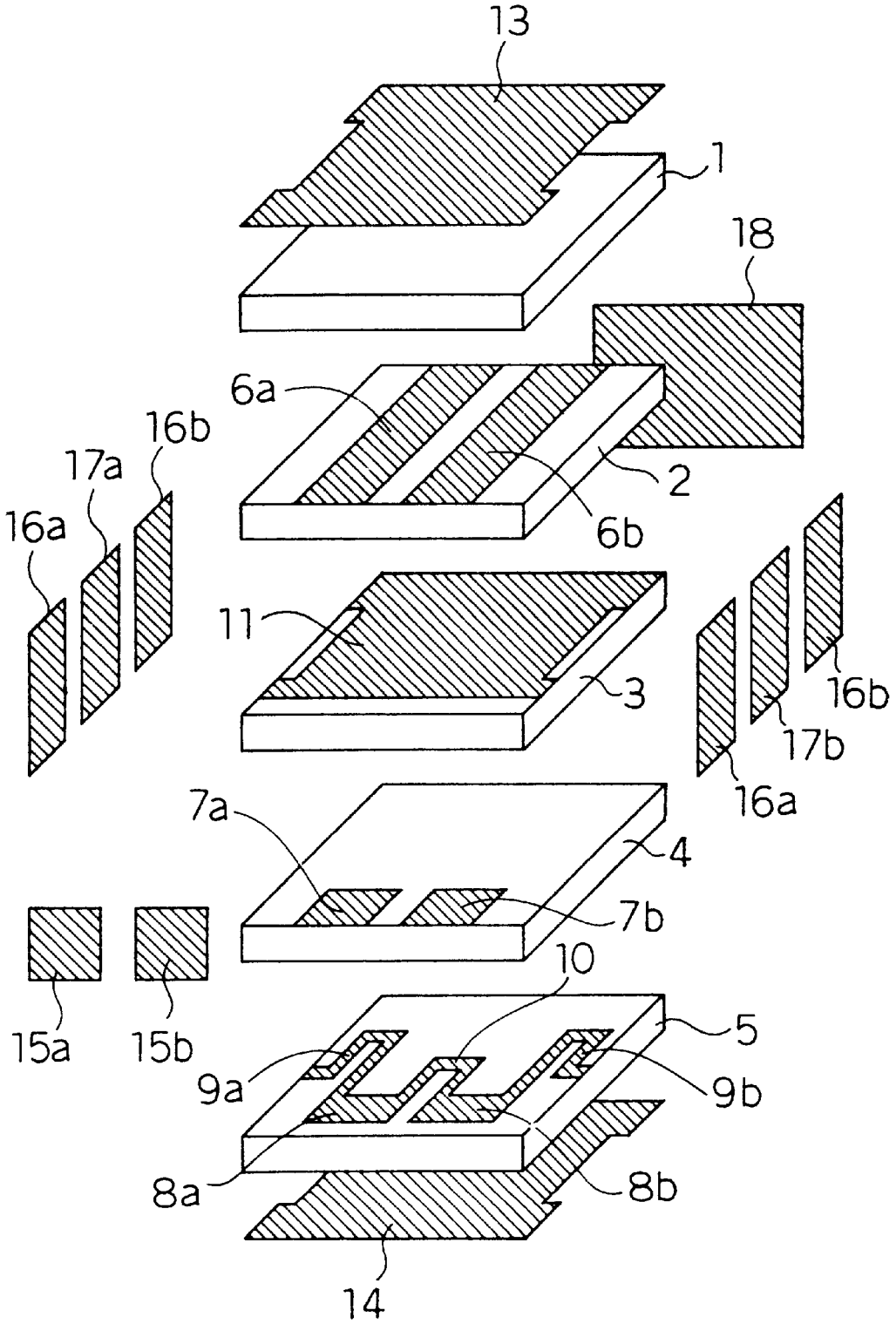
FIG. 1 is an exploded perspective view of a dielectric laminated filter according to a first and a second embodiments of this invention.
Figure 2:
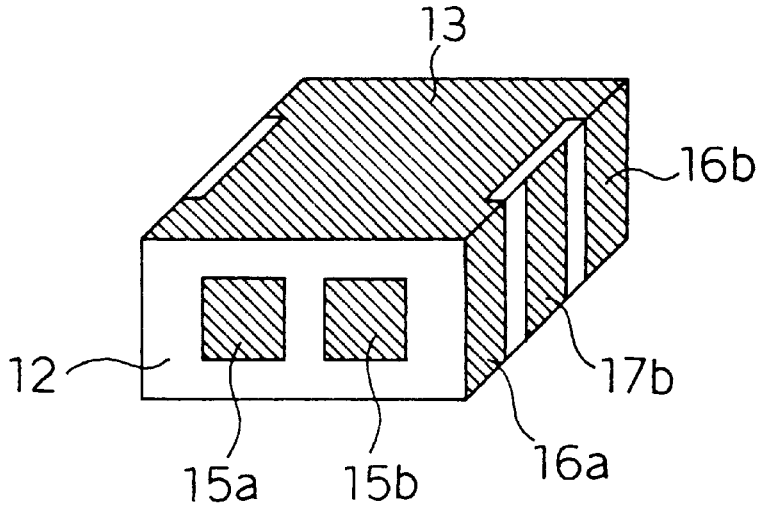
FIG. 2 is a perspective view of the dielectric laminated filter according to the first and the second embodiments of this invention.
Figure 3:
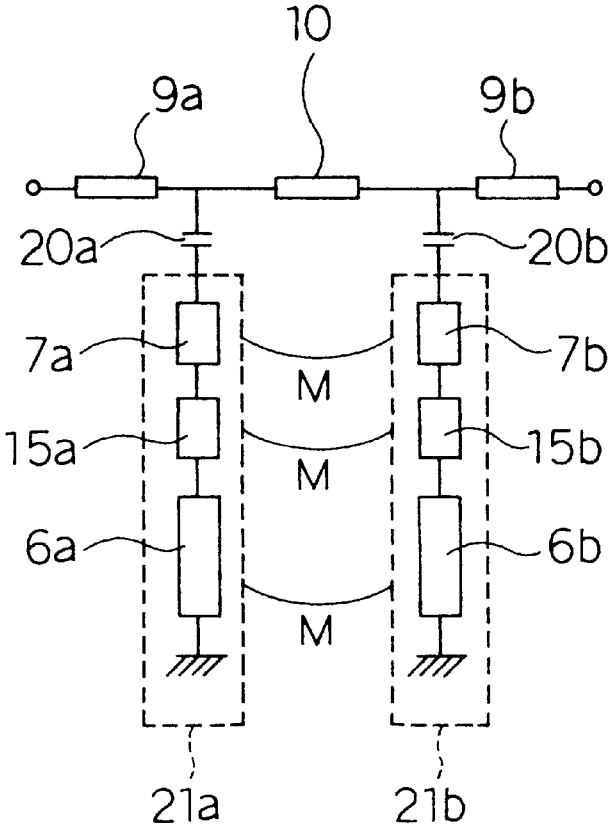
FIG. 3 is an equivalent circuit diagram of the dielectric laminated filter according to the first and the second embodiments of this invention.

FIG. 1 is an exploded perspective view of a dielectric laminated filter according to one embodiment of this invention. FIG. 2 is a perspective view of the dielectric laminated filter according to this embodiment (simply referred to as a "laminated body"). FIG. 3 shows an equivalent circuit of the dielectric laminated filter according to this embodiment.

In FIGS. 1 and 2, reference numerals 1, 2, 3, 4, and 5 designate dielectric sheets. These dielectric sheets comprise dielectric ceramic of the same material that has been formed into a green sheet and that can be sintered at a low temperature ($\epsilon r$=7 to 100. $\epsilon r$ is a dielectric constant).

Reference numerals 6*a* and 6*b* indicate first strip line electrodes corresponding to first resonance electrodes according to this invention. The first strip line electrodes 6*a* and 6*b* are formed on the top surface of the dielectric sheet 2, extend from one side to the other, and are disposed in parallel to each other. Reference numerals 7*a* and 7*b* indicate second strip line electrodes corresponding to second resonance electrodes according to this invention, are formed on the top surface of the dielectric sheet 4, and extend over a portion to the other of the dielectric sheet 4. Reference numerals 8*a* and 8*b* denote notch capacity electrodes, 9*a* and 9*b* are I/O line electrodes, and 10 is a coupling line electrode. All these electrodes are formed on the top surface of the dielectric sheet 5. The notch capacity electrodes 8*a* and 8*b* are formed opposite to the second strip line electrodes 7*a* and 7*b*. The I/O line electrodes 9*a* and 9*b* and the coupling line electrode 10 are formed in positions such that they are not opposed to the second strip line electrodes 7*a* and 7*b*. One end of the I/O line electrode 9*a* and one end of the coupling line electrode 10 are connected to the notch capacity electrode 8*a*, and one end of the I/O line electrode 9*b* and the other end of the coupling line electrode 10 are connected to the notch capacity electrode 8*b*. Reference numeral 11 denotes a first shield electrode formed on the top surface of the dielectric sheet 3.

In this manner, these inner electrodes formed in the internal layers of the laminated body have electrode patterns printed thereon using metallic paste such as silver, copper, or gold having a high conductivity.

Furthermore, 12 is the laminated body formed by laminating the dielectric sheets 5, 4, 3, 2, and 1 in this order, pressing them, and simultaneously sintering each dielectric sheet and each inner electrode.

Of course, a plurality of dielectric laminated filters may be simultaneously manufactured from the same laminated body. In this case, a cutting process for cutting the laminated body into a plurality of laminated body pieces is required between the pressing process and the sintering process. These cut laminated body pieces correspond to the dielectric laminated filter.

In addition, 13 is a second shield electrode, 14 is a third shield electrode, and these electrodes are formed almost all over the top and the bottom surfaces of the laminated body 12, respectively. Reference numerals 15*a* and 15*b* are third strip line electrodes corresponding to third resonance electrodes according to this invention. The third strip line electrodes 15*a* and 15*b* are formed on one of the outer circumferential sides of the laminated body 12. The third strip line electrode 15*a* is connected to one end of the first strip line electrode 6*a* and one end of the second strip line electrode 7*a*. The third strip line electrode 15*b* is connected to one end of the first strip line electrode 6*b* and one end of the second strip line electrode 7*b*. Reference numerals 16*a* and 16*b* are connection electrodes formed on the two opposite outer circumferential sides of the laminated body 12 and connected to each of the shield electrodes 11, 13, and 14. Reference numerals 17*a* and 17*b* are I/O electrodes formed on the two outer circumferential sides of the laminated body 12. The I/O electrode 17*a* is connected to the other end of the I/O line electrode 9*a* and the I/O electrode 17*b* is connected to the other end of the I/O line electrode 9*b*. Reference numeral 18 is a ground terminal formed on one of the outer circumferential sides of the laminated body 12 and connected to the other end of each of the shield electrodes 11, 13, and 14 and the other ends of the first strip line electrodes 6*a* and 6*b*. In this manner, the outer electrodes formed on the external surfaces of the laminated body are formed by printing or plating electrode patterns using metallic paste such as silver, copper, or gold having a high conductivity. The first dielectric laminated block according to this invention corresponds to a block including the dielectric sheets 1 and 2. The second dielectric laminated block according to this invention corresponds to a block including the dielectric sheets 3, 4, and 5.

The dielectric laminated filter of this configuration is further described with reference to FIGS. 1, 2, and 3.

The other end of the first strip line electrodes 6*a* and 6*b* are grounded via the ground electrode 18 to constitute tip shorting strip line resonators 21*a* and 21*b* that use the other ends of the second strip line electrodes 7*a* and 7*b* as open ends. In addition, the notch capacity electrodes 8*a* and 8*b* are formed opposite to the second strip line electrodes 7*a* and 7*b* to constitute the notch capacity elements 12*a* and 12*b*. Furthermore, the I/O line electrodes 9*a* and 9*b* and the coupling line electrode 10 act as coupling elements for distributed constant lines. Thus, by connecting the I/O line electrodes 9*a* and 9*b* and the coupling line electrode 10 to the notch capacity electrodes 8*a* and 8*b* as described above, the tip shorting strip line resonators 21*a* and 21*b* are connected in parallel via the notch capacity elements 20*a* and 20*b* as shown in the equivalent circuit diagram in FIG. 3. This allows a band elimination filter using the I/O electrodes 17*a* and 17*b* as I/O terminals to be provided.

As described above, this embodiment can laminate via the first shield electrode 11, the first dielectric laminated block including the first strip line electrodes 6*a* and 6*b* and the second dielectric laminated block including the second strip line electrodes 7*a* and 7*b* and coupling elements in order to prevent the unwanted electromagnetic coupling between the first strip line electrodes 6*a* and 6*b* and the I/O line electrodes 9*a* and 9*b* acting as the coupling elements and between the first strip line electrodes 6*a* and 6*b* and the coupling line electrode 10.

The important point of this embodiment is the use of the structure in which the tip shorting strip line resonators 21*a* and 21*b* use the other ends of the second strip line electrodes 7*a* and 7*b* as open ends. This structure causes a field distribution to dominate in the second strip line electrodes, thereby allowing the magnetic coupling within the second dielectric laminated block to be neglected. In other words, the field coupling between the second strip line electrodes 7*a* and 7*b* and the notch capacity electrodes 8*a* and 8*b* is used to form the notch capacity elements 20*a* and 20*b* (see FIG. 3).

Furthermore, by disposing the I/O line electrodes 9*a* and 9*b* and the coupling line electrode 10 in such a way that they are not opposed to the second strip line electrodes 7*a* and 7*b*, the unwanted field coupling with the second strip line electrodes 7*a* and 7*b* can be reduced to a negligible magnitude.

As described above, the unwanted field coupling between the resonators (that is, the tip shorting strip line resonators 21*a* and 21*b*) and the I/O lines (that is, the I/O line electrodes 9*a* and 9*b*) and between the resonators and the coupling element (that is, the coupling line electrode 10) can be reduced to a negligible magnitude, thereby enabling easy design and providing a good band elimination filter characteristic.

Figure 23:
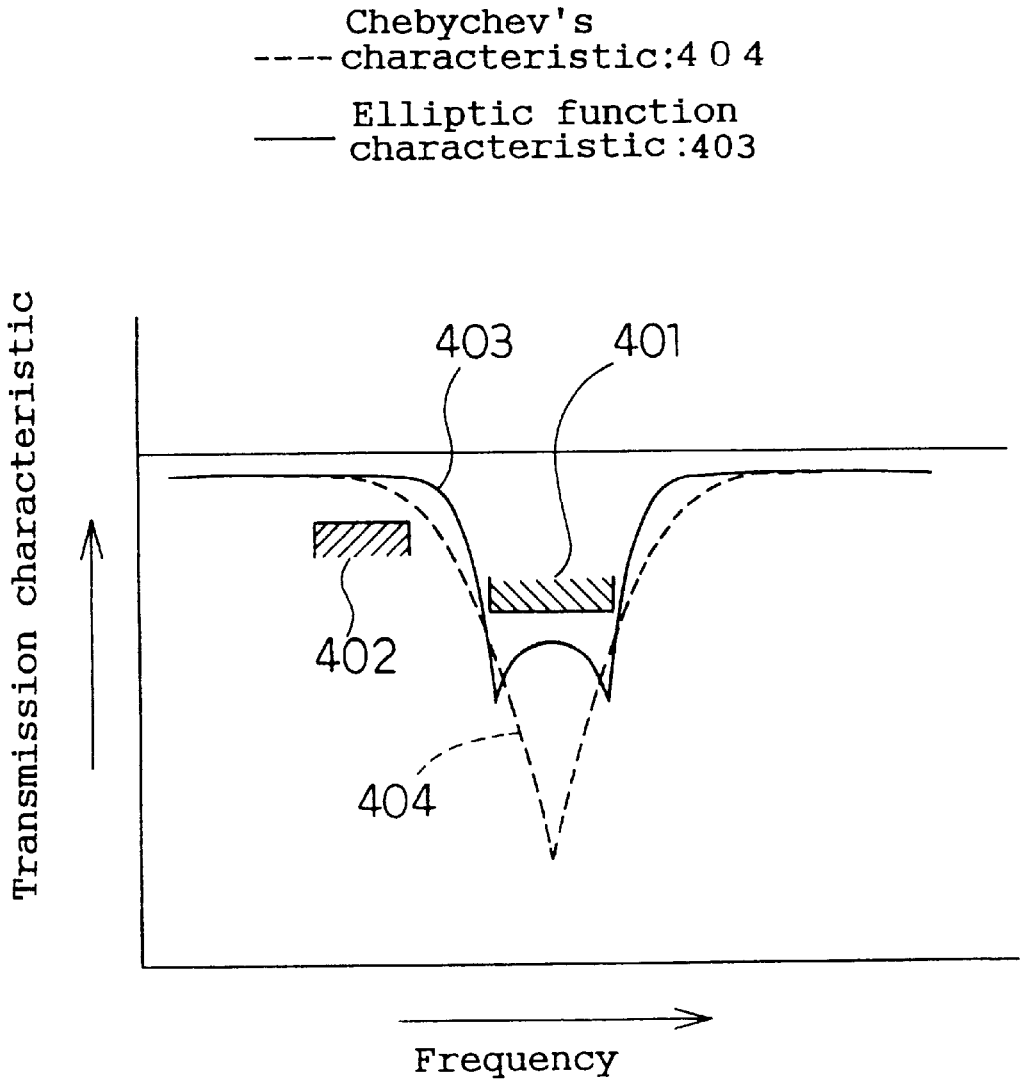
FIG. 23 is a graph comparing an elliptic function characteristic and a Chebyshev's characteristic in a band elimination filter.

In addition, by appropriately combining the electromagnetic coupling between the resonators with the coupling line electrode 10 to achieve an elliptic function characteristic, a steep attenuation characteristic curve can be obtained compared to a Chebychev's characteristic 404 that does not use the electromagnetic coupling M between the resonators, as shown in FIG. 23.

For example, FIGS. 27A to 27F show the transmission characteristic of a band elimination filter in which two strip line resonators are connected in parallel using a coupling line.

Figure 27A:
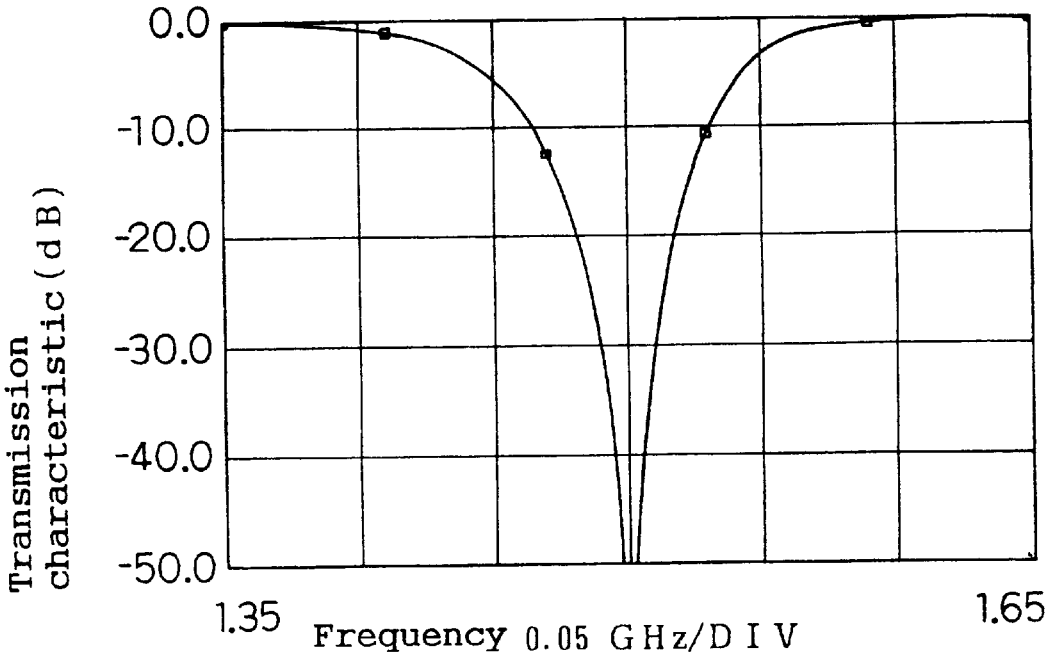
FIGS. 27A to 27F are graphs describing the elliptic function characteristic in this invention.

FIG. 27A is a graph showing a transmission characteristic obtained when the coupling line has an impedance of 50 Ω and a line length of a quarter wavelength at 1.5 GHz if there is no electromagnetic coupling between the resonators.

Figure 27B:
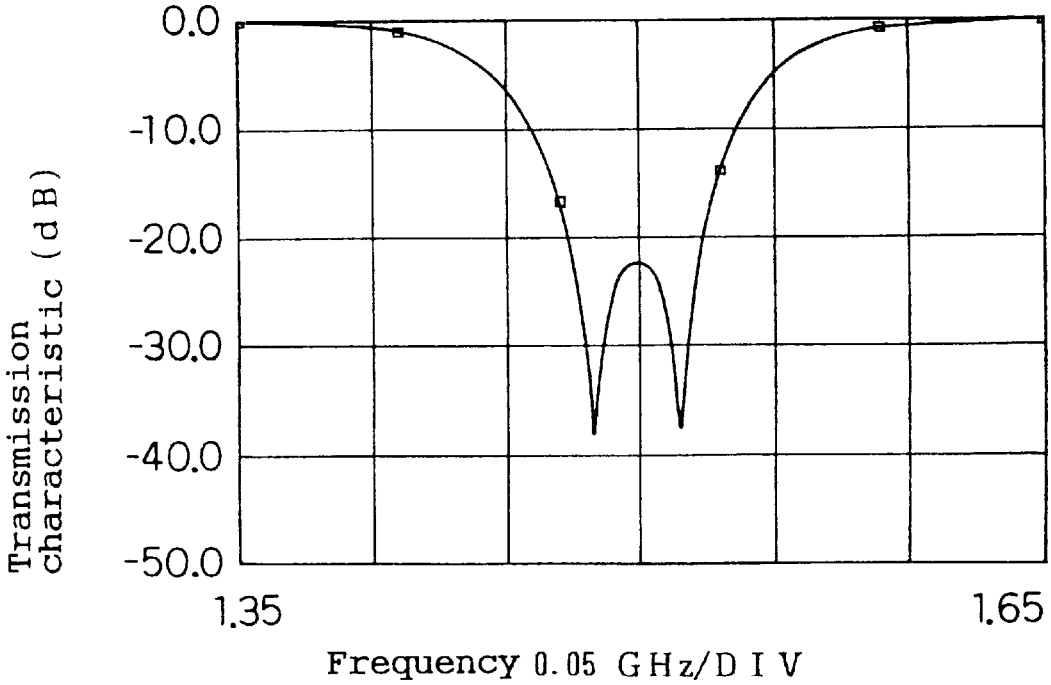

FIG. 27B is a graph that is the same as FIG. 27A except that the resonance frequency is offset.

Figure 27C:
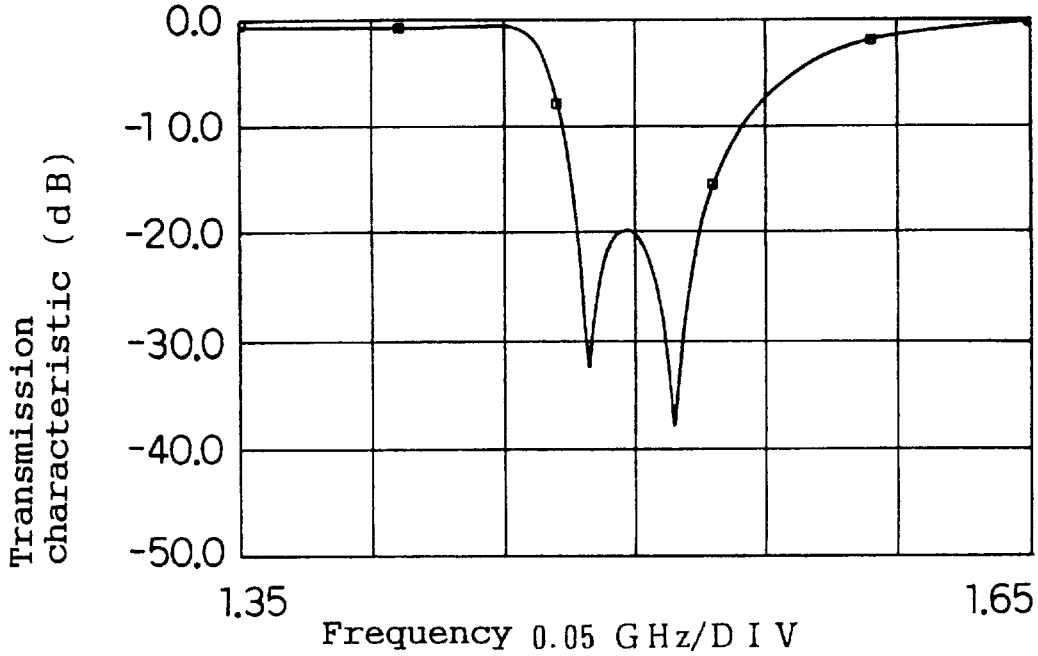

FIG. 27C is a graph that is the same as FIG. 27B except that the coupling line length is a one-eighth wavelength at 1.5 GHz.

Figure 27D:
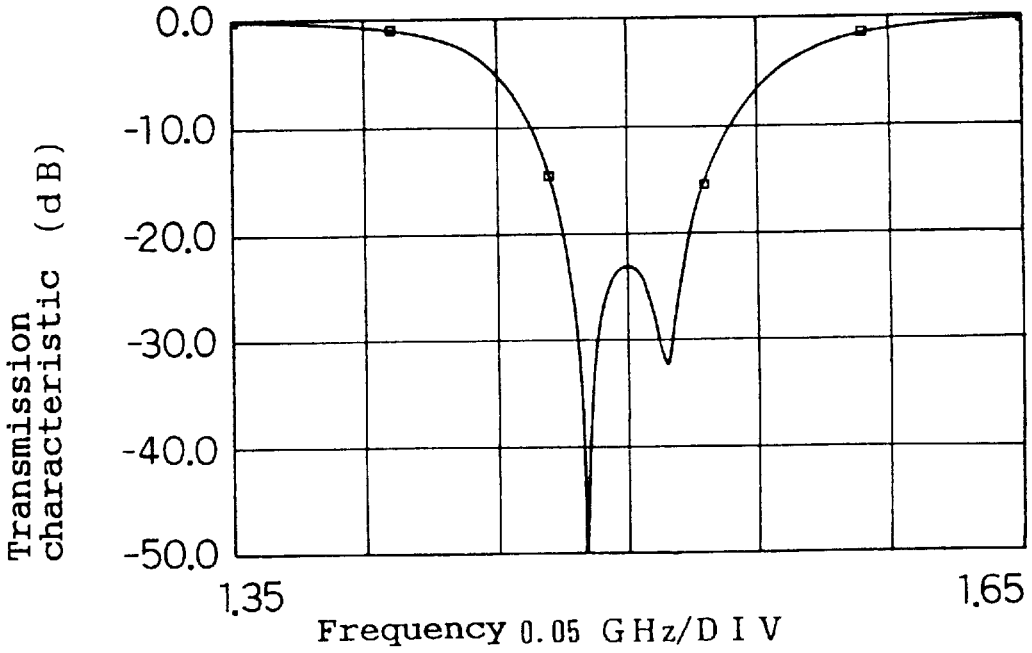

FIG. 27D is a graph that is the same as FIG. 27A except that there is electromagnetic coupling between the resonators.

Figure 27E:
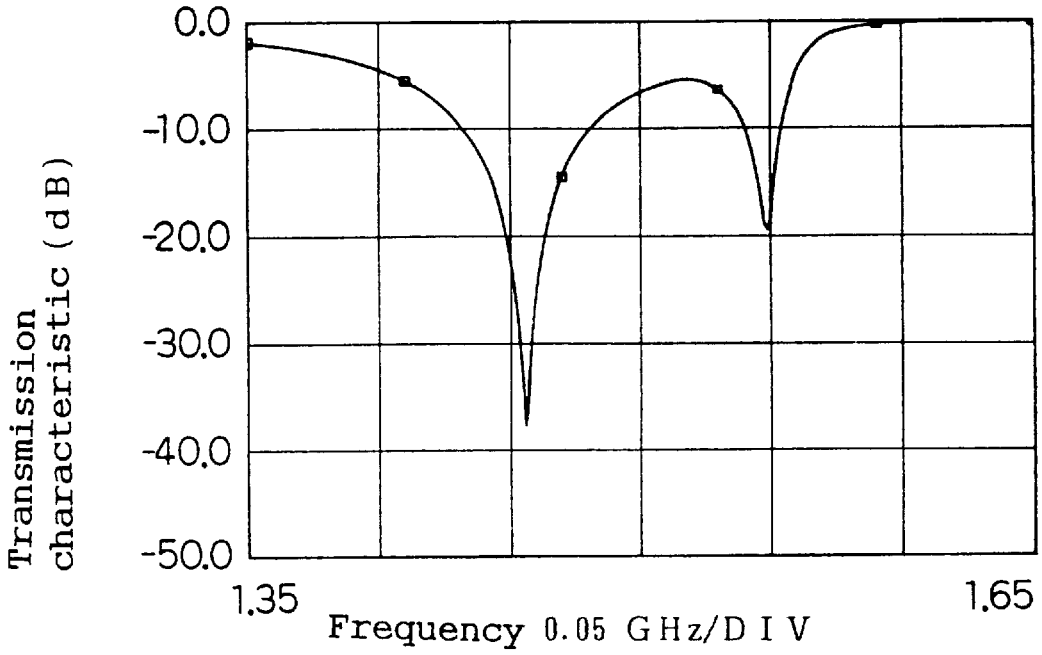

FIG. 27E is a graph that is the same as FIG. 27D except that the coupling line length is a one-eighth wavelength at 1.5 GHz.

Figure 27F:
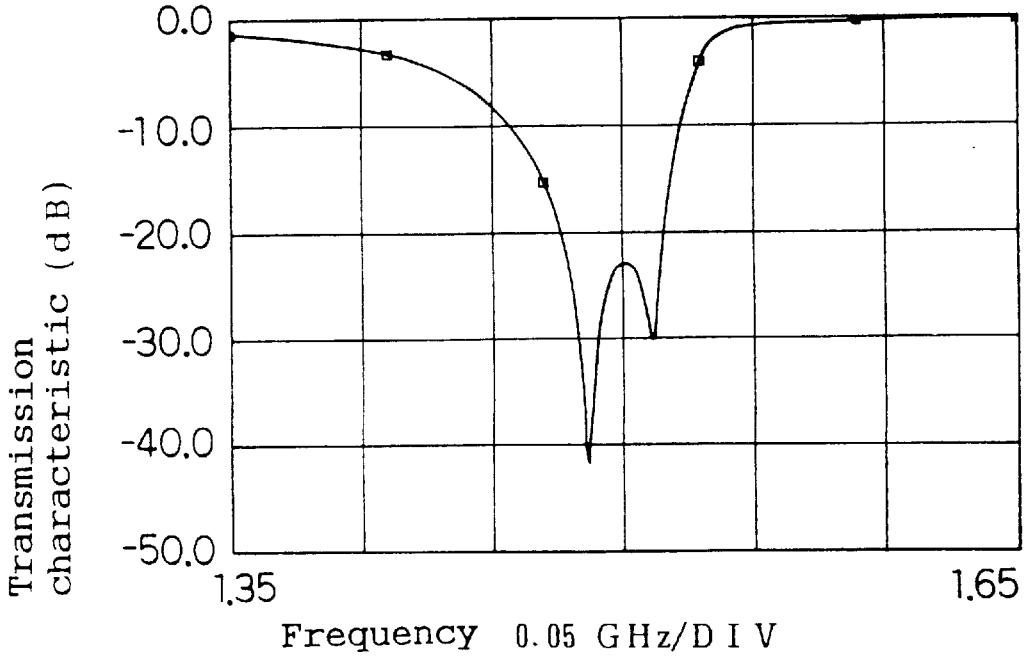

FIG. 27F is a graph that is the same as FIG. 27E except that the gap between the resonators is expanded to reduce the electromagnetic coupling.

As described above, changes in characteristic occurring when the coupling line is changed depend on whether or not there is electromagnetic coupling between the resonators (see FIGS. 27C and 27E). Consequently, to realize a steep elliptic function characteristic in the band elimination filter according to this embodiment, the behavior of the characteristic must be comprehensively considered in design.

Referring again to FIG. 23, insertion losses can be reduced in a pass band 402 used to obtain a desired attenuation band 401 and attenuation amount. Thus, the attenuation band 401 can be expanded without providing a multistage filter, thereby reducing the size of the filter and losses (increasing the performance).

If, for example, the line length of the coupling line cannot be configured to be a one-eighth wavelength or more due to a geometrical constraint, the electromagnetic coupling between the resonators can be combined together as shown in FIG. 27F to achieve an elliptic function characteristic with a steep attenuation characteristic curve.

That is, by appropriately combining the electromagnetic coupling M between the resonators with the coupling line electrode 10, coupling elements can be provided which have an impedance and a wavelength that cannot be configured only by the coupling line electrode 10 due to a geometrical constraint.

Thus, by eliminating unwanted electromagnetic coupling and using the electromagnetic coupling between the resonators, the degree of freedom can be increased and the dielectric constant of the dielectric sheets can be increased, thereby reducing the size of the resonators and improving the performance. Due to the active use of the electromagnetic coupling between the resonators, as described above, this embodiment has between the strip line electrodes 6*a* and 6*b* no earth electrode such as that described in the conventional dielectric laminated filter. An electromagnetic coupling prevention member according to this invention corresponds to the earth electrode.

Figure 26:
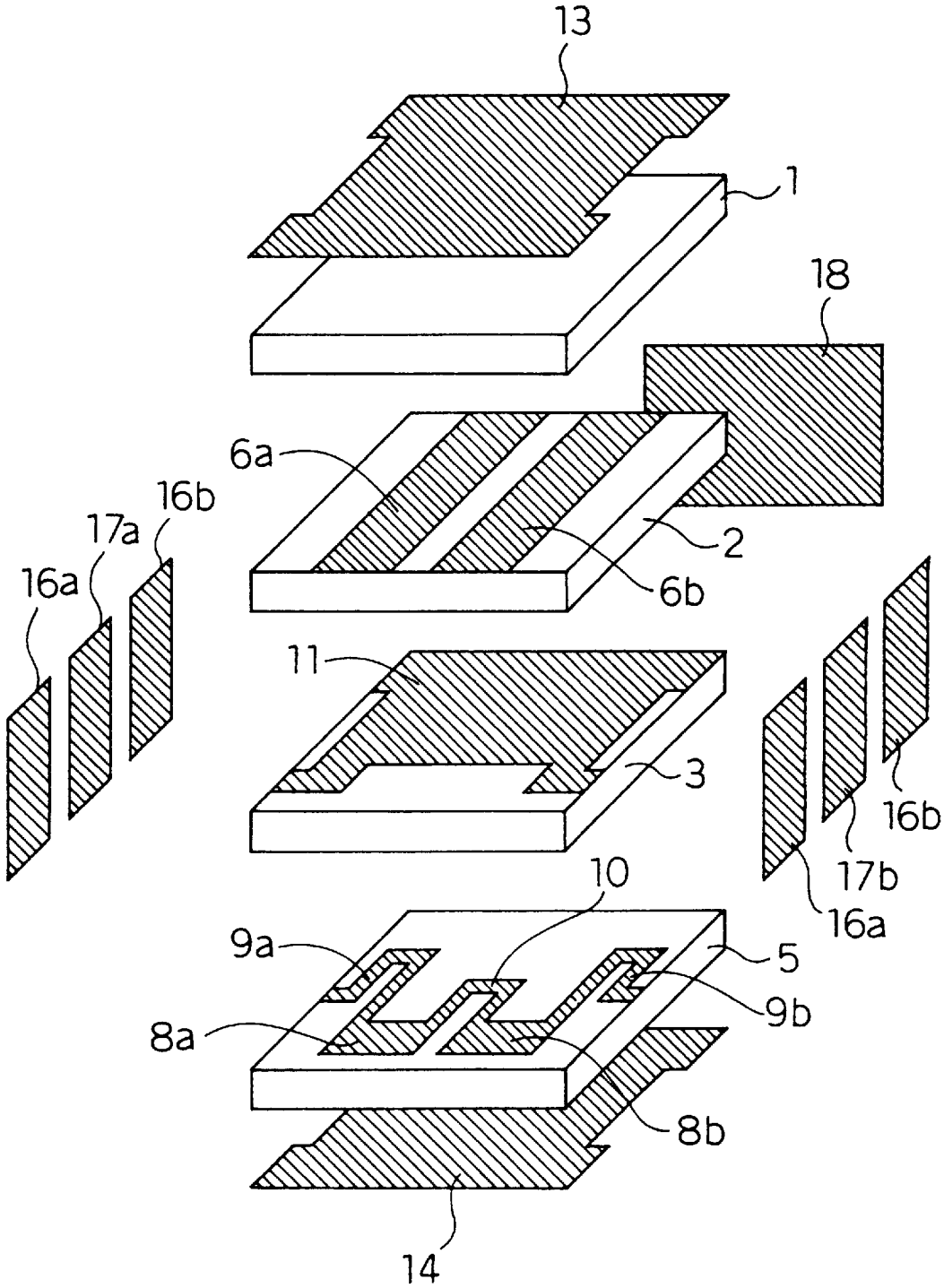
FIG. 26 is an exploded perspective view of a dielectric filter as a variation of the first embodiment of this invention.

Similar effects can be obtained by a structure comprising a dielectric laminated block formed by laminating a plurality of dielectric sheets 1, 2, 3, and 5; a plurality of strip lines 6*a* and 6*b* formed on an inner layer of the dielectric laminated block; a plurality of I/O lines 9*a* and 9*b* formed on an inner layer of the dielectric laminated block; and a coupling line 10 formed on an inner layer of the dielectric laminated block and connecting the plurality of strip lines in parallel, wherein a shield electrode 11 separates the plurality of strip lines 6*a* and 6*b* from the I/O lines 9*a* and 9*b* and the coupling line 10, as shown in FIG. 26.

In addition, the thickness of the dielectric sheet 4 can be reduced to reduce the area of the second strip line electrodes 7*a* and 7*b* and notch capacity electrodes 8*a* and 8*b* used to constitute the desired notch capacity elements 20*a* and 20*b* in order to increase the area used to form the coupling element without disposing it opposite to the second strip line electrodes 7*a* and 7*b*, thereby further increasing the degree of freedom in design.

Furthermore, by folding and connecting the first, the second, and the third strip line electrodes together to form the tip shorting strip line resonators 21*a* and 21*b*, the wavelength of the resonators can be increased without increasing the size of the laminated body, thereby reducing the size of the tip shorting strip line resonators 21*a* and 21*b*.

In addition, filter characteristics can be adjusted by forming the third strip line electrodes 15*a* and 15*b* of outer electrodes. That is, a trimming grinder or the like can be used to trim the third strip line electrodes 15*a* and 15*b* to adjust the interval between the electrodes in order to vary the electromagnetic coupling between the third strip line electrodes 15*a* and 15*b*, thereby allowing the attenuation band width within the band elimination filter characteristics to be adjusted.

By forming the connection electrodes 16*a* and 16*b* at the respective ends of the two opposite outer circumferential sides of the laminated body 12 and connecting the connection electrodes to each of the shield electrodes 11, 13, and 14, the same potential can be provided between the shield electrodes with a constant potential distribution maintained within each shield electrode, thereby providing stable filter characteristics with excellent shielding. These effects are significant at a frequency of more than 1 GHz.

Therefore, a small adjustable dielectric laminated filter that can be designed easily can be realized.

(Embodiment 2)

A dielectric laminated filter according to this embodiment is described below with reference to the drawings.

The structure of the dielectric laminated filter according to this embodiment is almost the same as that in the first embodiment except that the first and the second dielectric laminated blocks are formed of dielectric sheets of different dielectric constants.

That is, the dielectric constant of the dielectric sheets 1 and 2 differs from that of the dielectric sheets 3, 4, and 5.

As described above, this embodiment not only has the same effects as the first embodiment but, compared to the first embodiment, can also reduce the unwanted electromagnetic coupling between the resonators and the I/O lines and between the resonators and the coupling element without increasing the size of the dielectric laminated filter by making the dielectric sheets 1 and 2 of a material of a low dielectric constant and making the dielectric sheets 3, 4, and 5 of a material of a high dielectric constant.

In addition, the dielectric sheets 2 and 3 of different materials can be laminated via the first shield electrode to reduce changes in material caused by the chemical binding between different materials, thereby enabling different materials to be laminated easily, compared to the prior art.

(Embodiment 3)

A third embodiment of this invention is described below with reference to the drawings.

Figure 4:
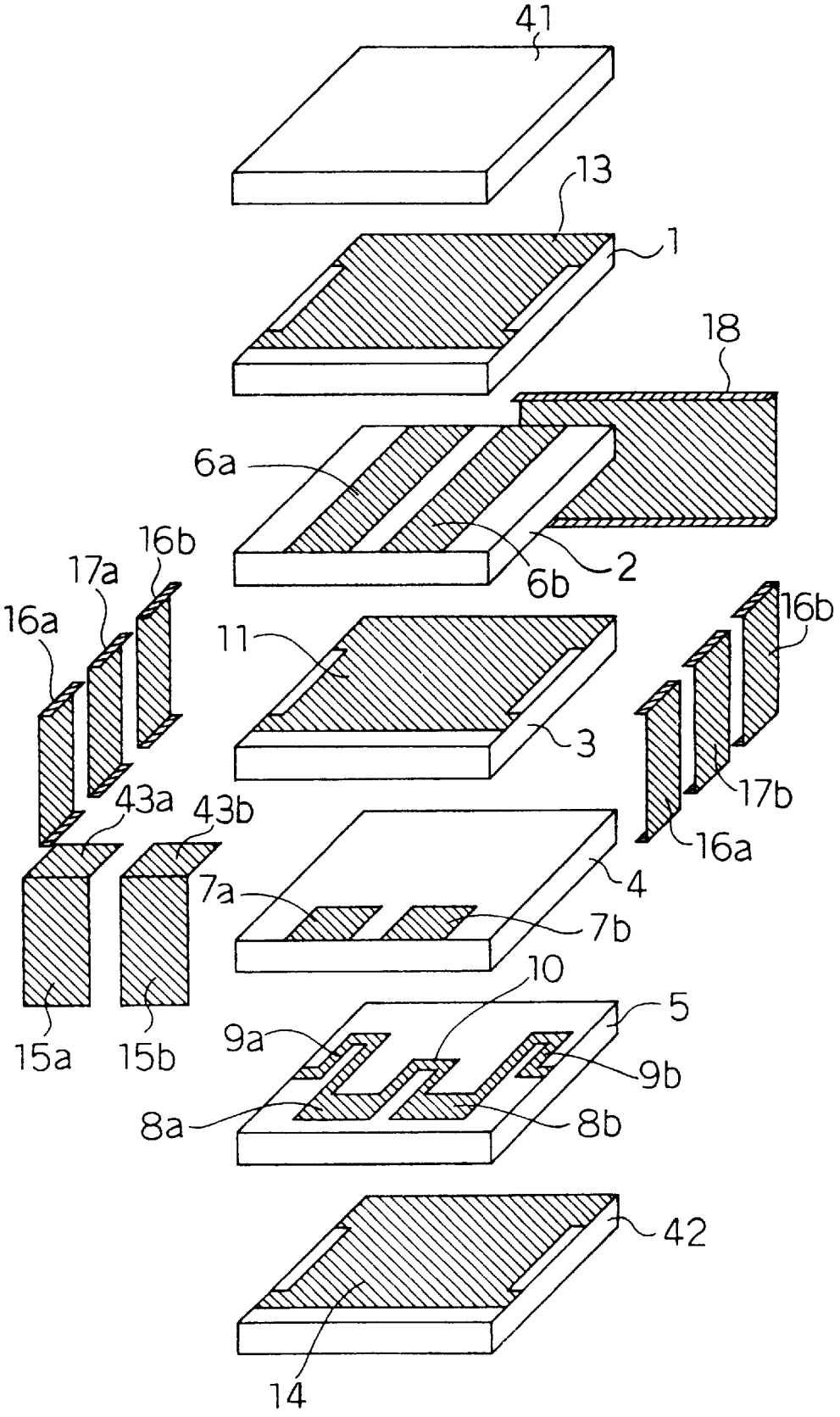
FIG. 4 is an exploded perspective view of a dielectric laminated filter according to a third embodiment of this invention.
Figure 5:
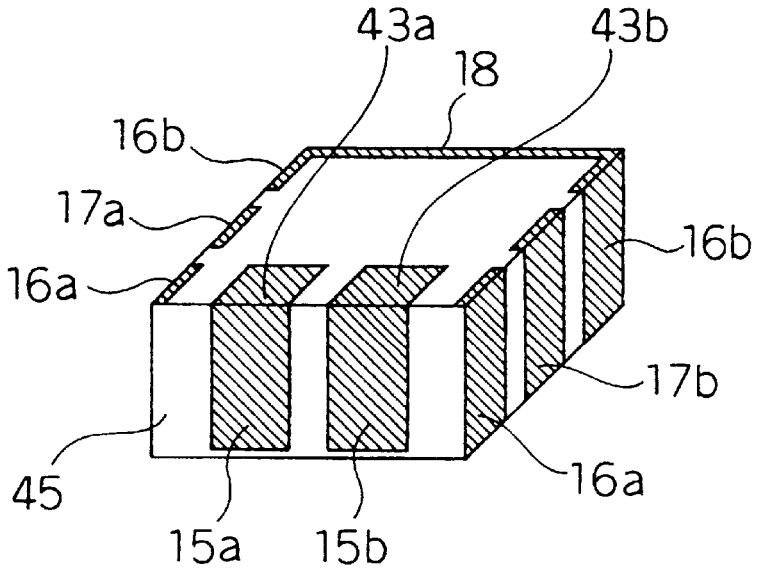
FIG. 5 is a perspective view of the dielectric laminated filter according to the third embodiment of this invention.
Figure 6:
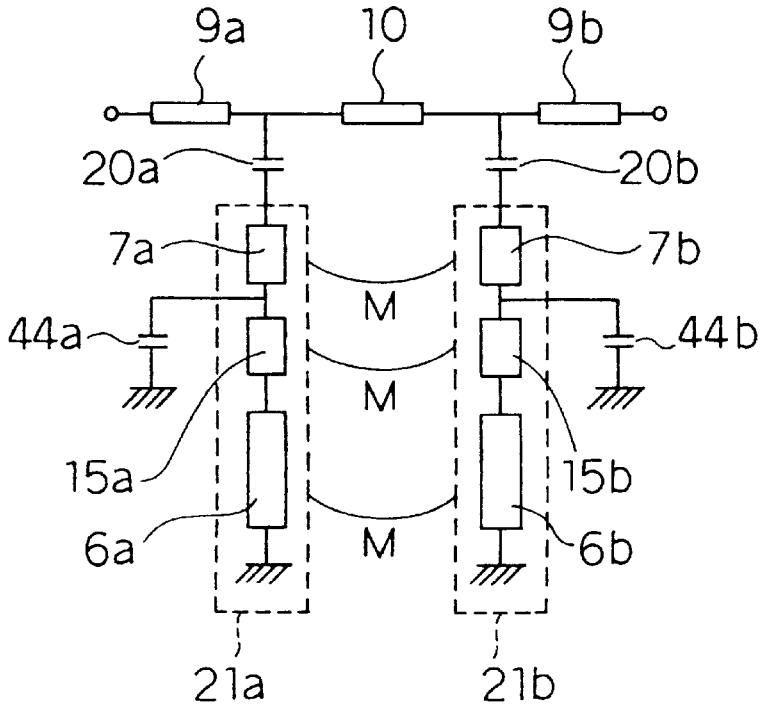
FIG. 6 is an equivalent circuit diagram of the dielectric laminated filter according to the third embodiment of this invention.

FIG. 4 is an exploded perspective view of a dielectric laminated filter according to this embodiment of the invention. FIG. 5 is a perspective view of a dielectric body according to this embodiment. FIG. 6 shows an equivalent circuit of the dielectric laminated filter according to this embodiment.

As shown in FIGS. 4 and 5, the structure of this dielectric laminated filter is the same as that in the first embodiment except for the following points.

The second and the third shield electrodes 13 and 14 are formed as inner electrode and dielectric sheets 41 and 42 are laminated on the top and the bottom surfaces to form a laminated body 45. The third strip line electrodes 15*a* and 15*b* are formed to extend up to the top surface of the dielectric sheet 41.

As describe above, this embodiment not only has the same effects as the first embodiment but can also reduce the resonance frequency of the tip shorting strip line resonators 21*a* and 21*b* (see FIG. 6) by extending the third strip line electrodes 15*a* and 15*b* up to the top surface of the dielectric sheet 41 to form ground capacity elements 44*a* and 44*b* between the third strip line electrodes 15*a* and 15*b* and the second shield electrode 13. Consequently, the length of the tip shorting strip line resonators 21*a* and 21*b*, that is, the wavelength can be reduced.

In addition, by trimming partial line electrodes 43*a* and 43*b* that are formed on the top surface of the dielectric sheet 41 and that are part of the third strip line electrodes 15*a* and 15*b*, the capacity (capacitance) of the ground capacity elements 44*a* and 44*b* can be varied to adjust the resonance frequency of the tip shorting strip line resonators 21*a* and 21*b*. This adjustment can be normally provided in the middle of a manufacturing process to absorb the dispersion of dielectric sheets and electrode patterns, thereby improving the yield.

Furthermore, if the connection electrodes 16*a* and 16*b*, the I/O electrodes 17*a* and 17*b*, and the ground electrode 18 are extended up to the top surface of the dielectric sheet 41 and the bottom surface of the dielectric sheet 42 and if the laminated body is mounted on a substrate by reflow soldering, the solder can be more effectively attached to each electrode surface and firmly mounted, thereby improving the reliability of mounting.

Therefore, a small dielectric laminated filter that has higher designability and adjustability than the first embodiment can be realized.

Figure 16:
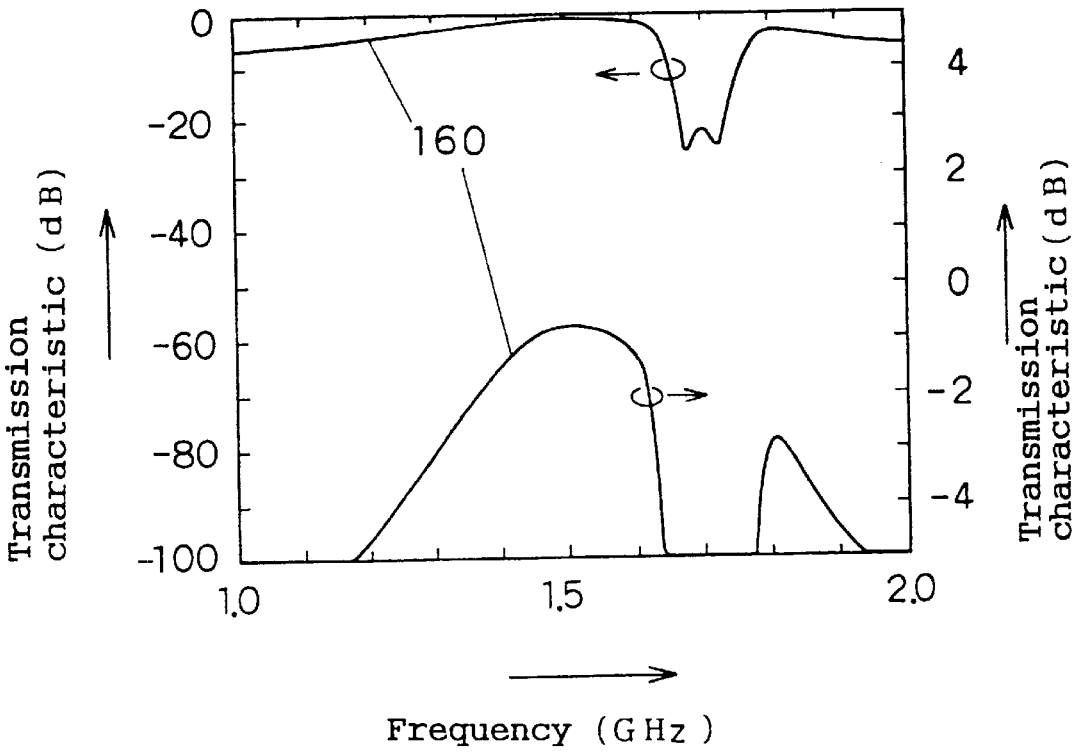
FIG. 16 is a graph showing the frequency characteristic of a dielectric laminated filter experimentally manufactured in the third embodiment.

FIG. 16 is a graph showing the frequency characteristic of a dielectric laminated filter experimentally manufactured according to this embodiment. Dielectric sheets with a dielectric constant of $\epsilon r=58$ were used and the laminated body 45 had a size of 4.5×3.2×2.0 mm. The electromagnetic coupling between the resonators and the coupling line electrode 10 were, as described above, appropriately combined together to achieve an elliptic function characteristic 403 such as that shown in FIG. 23.

(Embodiment 4)

A fourth embodiment of this invention is described below with reference to the drawings.

Figure 7:
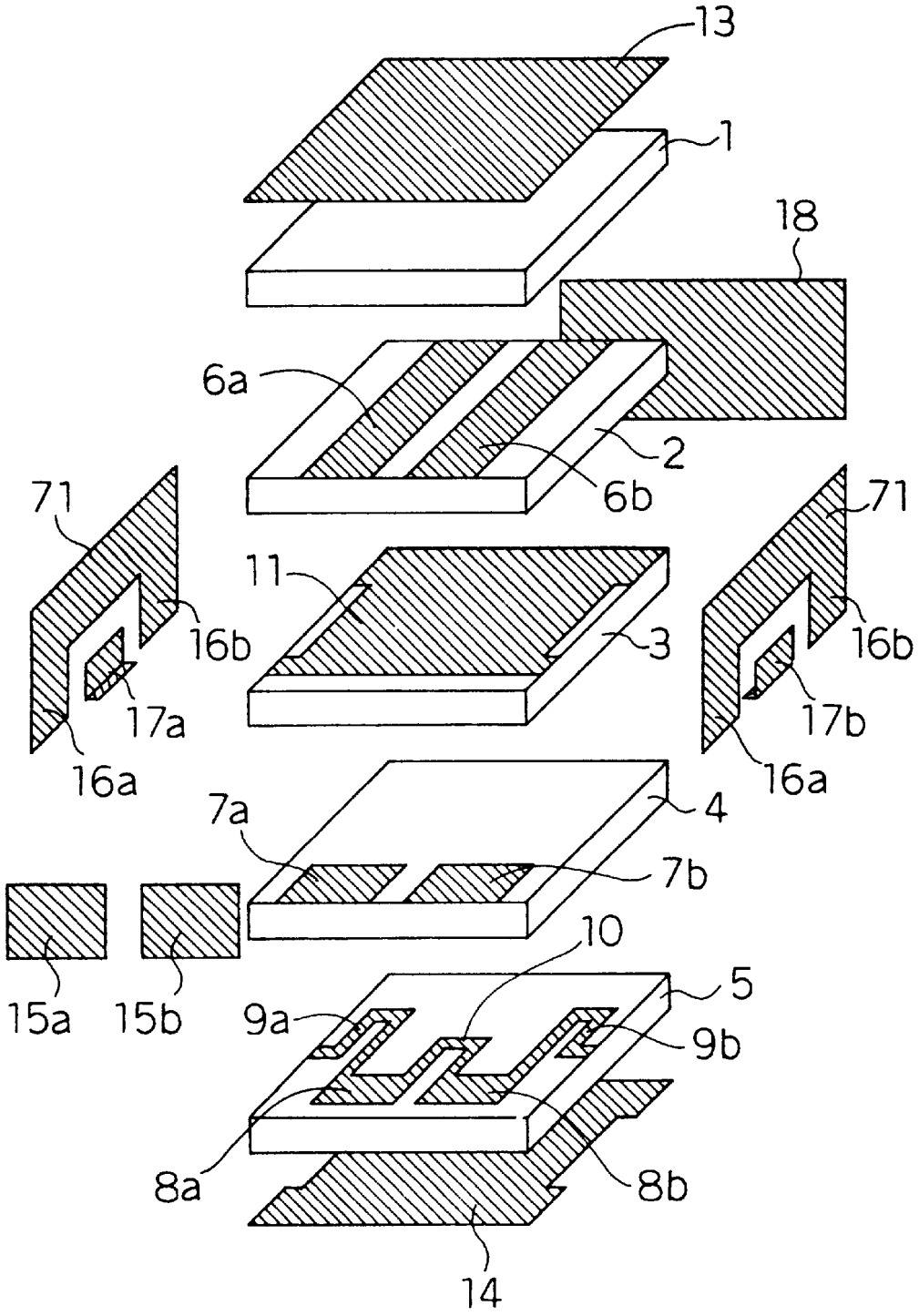
FIG. 7 is an exploded perspective view of a dielectric laminated filter according to a fourth embodiment of this invention.
Figure 8:
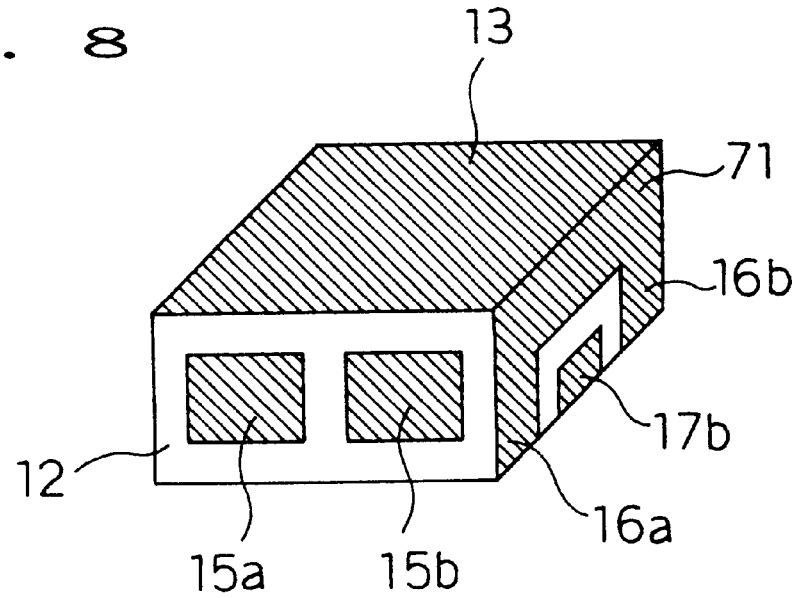
FIG. 8 is a perspective view of the dielectric laminated filter according to the fourth embodiment of this invention.
Figure 9:
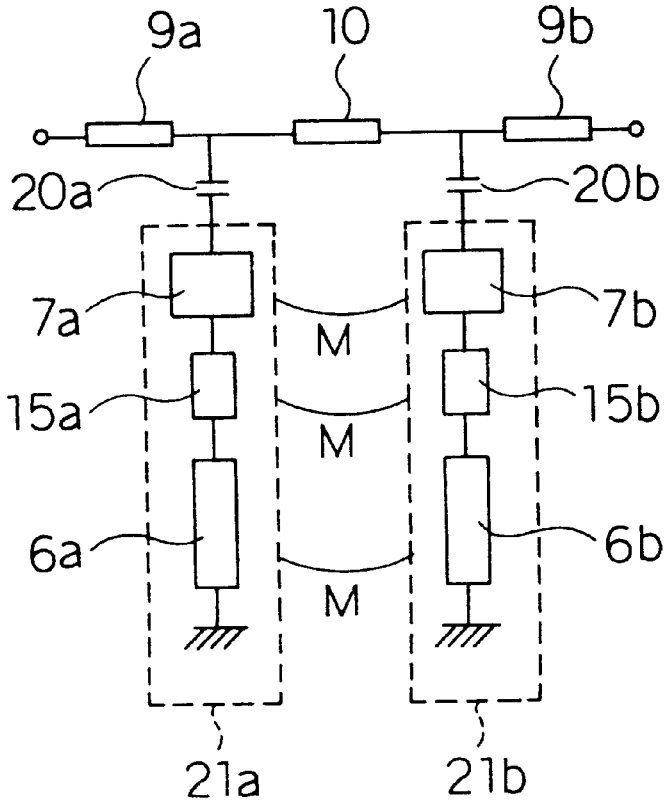
FIG. 9 is an equivalent circuit diagram of the dielectric laminated filter according to the fourth embodiment of this invention.

FIG. 7 is an exploded perspective view of a dielectric laminated filter according to this embodiment of the invention. FIG. 8 is a perspective view of a dielectric body according to this embodiment. FIG. 9 shows an equivalent circuit of the dielectric laminated filter according to this embodiment.

As shown in FIGS. 7 and 8, the structure of this dielectric laminated filter is the same as that in the first embodiment except for the following points.

The second shield electrode 13 is formed all over the surface of the laminated body 12. The ground electrode 18 is formed all over one of the outer circumferential sides of the laminated body 12. A fourth shield electrode 71 is formed all over two opposite sides of the dielectric sheets 1 and 2 to connect the connection electrodes 16*a* and 16*b* to the fourth shield electrode 71. In addition, the line width of the second strip line electrodes 7*a* and 7*b* is formed to be larger than that of the first strip line electrodes 6*a* and 6*b*.

As described above, this embodiment not only has the same effects as the first embodiment but also improves the shielding capability of the first strip line electrodes 6*a* and 6*b* with a large magnetic density to reduce radiation losses because the shield electrode is formed all over the top surface and all the outer circumferential sides of the first dielectric laminated block other than the one on which the third strip line electrodes 15*a* and 15*b* are formed, the first dielectric laminated block including the dielectric sheets 1 and 2 and the first strip line electrodes 6*a* and 6*b*. As a result, the unloaded Q of the tip shorting strip line resonators 21*a* and 21*b* (see FIG. 9) can be improved to realize a high performance dielectric laminated filter.

The line width of the second strip line electrodes 7*a* and 7*b* is formed to be larger than that of the first strip line electrodes 6*a* and 6*b* in order to cause the impedance of the tip shorting strip line resonators 21*a* and 21*b* to be abruptly varied like a step. This provides SIR resonators to enable the resonance frequency and the length of the resonators to be reduced in order to realize a small dielectric laminated filter.

(Embodiment 5)

A fifth embodiment of this invention is described below with reference to the drawings.

Figure 10:
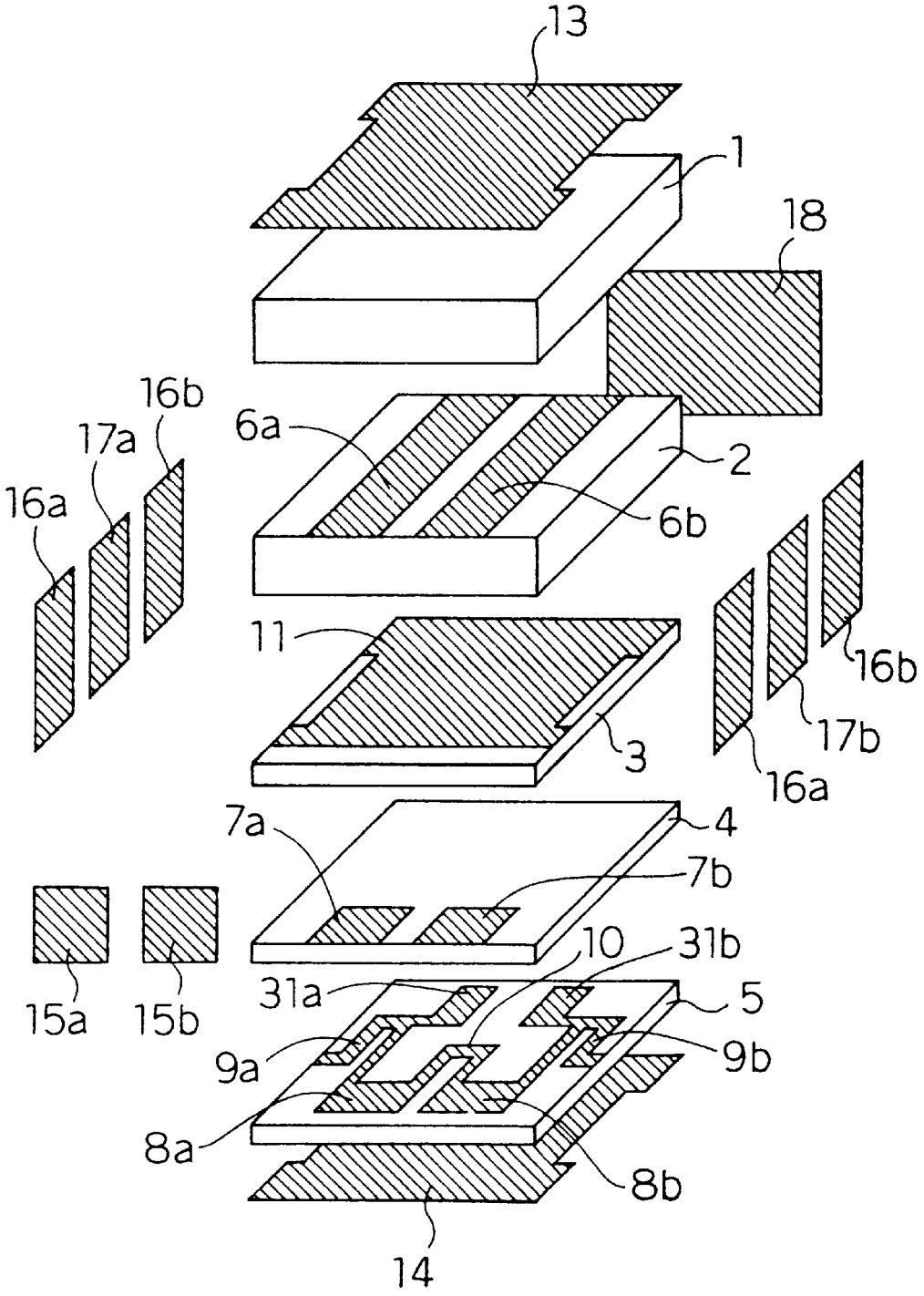
FIG. 10 is an exploded perspective view of a dielectric laminated filter according to a fifth embodiment of this invention.
Figure 11:
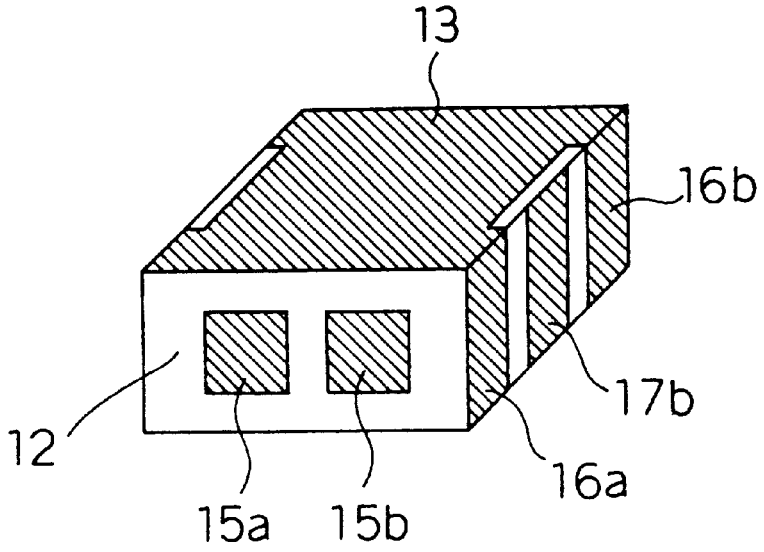
FIG. 11 is a perspective view of the dielectric laminated filter according to the fifth embodiment of this invention.
Figure 12:
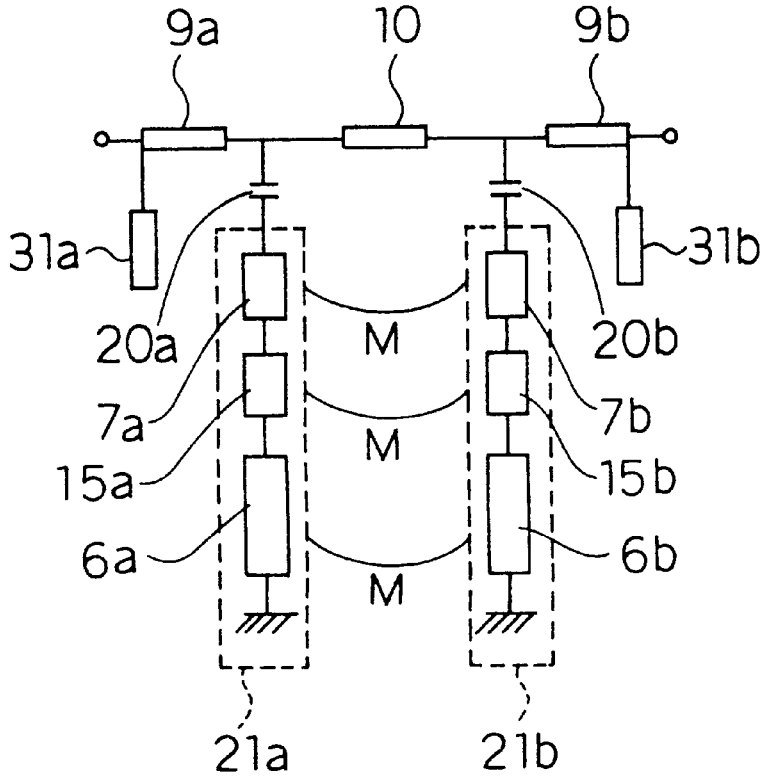
FIG. 12 is an equivalent circuit diagram of the dielectric laminated filter according to the fifth embodiment of this invention.
Figure 13:
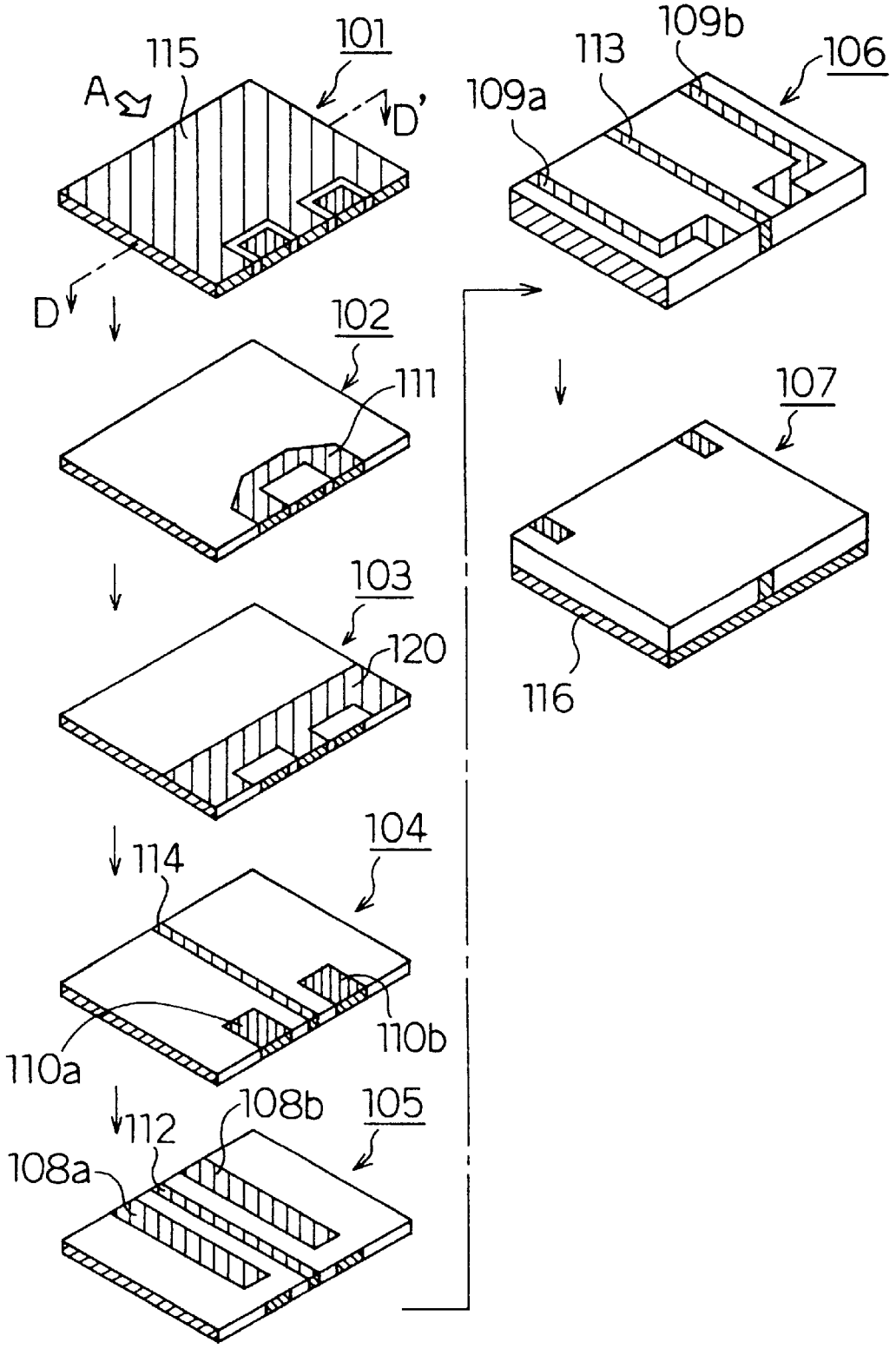
Fig. 13 PRIOR ART
FIG. 13 is an exploded perspective view of a conventional dielectric laminated film.
Figure 14:
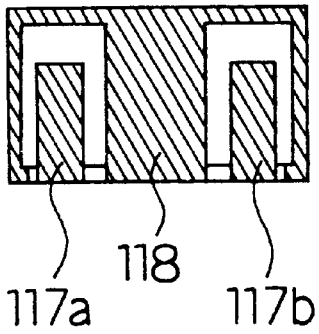
Fig. 14 PRIOR ART
FIG. 14 is an explanatory drawing showing the conventional dielectric laminated filter as seen from the direction shown by arrow A.
Figure 15:
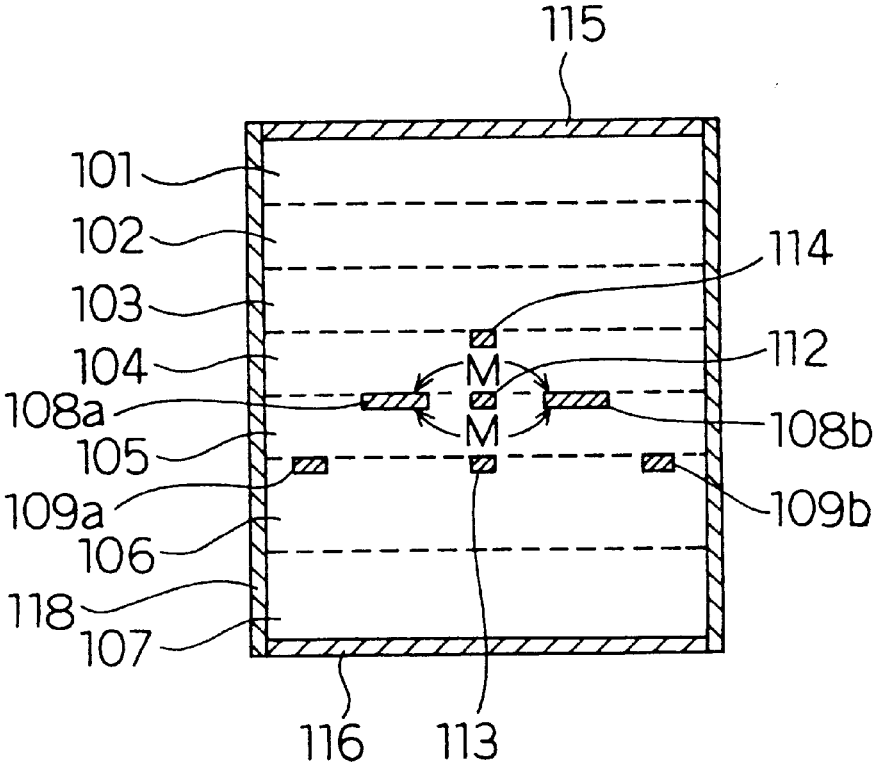
Fig. 15 PRIOR ART
FIG. 15 is a cutaway cross sectional view in which the conventional dielectric laminated filter is cut along line D-D'.

FIG. 10 is an exploded perspective view of a dielectric laminated filter according to this embodiment of the invention. FIG. 11 is a perspective view of a dielectric body according to this embodiment. FIG. 12 shows an equivalent circuit of the dielectric laminated filter according to this embodiment.

The structure in FIGS. 10 and 11 is the same as that in the first embodiment except for the following points. First, open stubs 31*a* and 31*b* are formed on the top surface of the dielectric sheet 5 to connect the I/O line electrodes 9*a* and 9*b* in parallel. Second, the second dielectric block has a smaller thickness than the first dielectric block.

As described above, this embodiment not only has the same effects as the first embodiment but can also size the open stubs 31*a* and 31*b* so as to have a length equal to a quarter wavelength at frequencies double and triple the fundamental pass band to form an attenuating pole at these frequencies. This attenuating pole is effective in attenuating a second and a third harmonic bands and enables an attenuating pole to be formed without affecting the characteristics of the fundamental frequency band.

In addition, the thickness of the second dielectric block (corresponding to the laminated portion including the dielectric sheets 3, 4, and 5) can be reduced below that of the first dielectric block (corresponding to the laminated portion including the dielectric sheets 1 and 2) to reduce the impedance of the second strip line electrodes 7*a* and 7*b* below that of the first strip line electrodes 6*a* and 6*b*, thereby enabling the impedance of the tip shorting strip line resonators 21*a* and 21*b* to be abruptly varied like a step. That is, SIR resonators can be provided to reduce the resonance frequency and thus the length of the resonators.

Consequently, this embodiment can attenuate high-order harmonic bands without the need to add an LPF, thereby reducing the size and losses of the multi-functional filter. Due to its ability to reduce the length of the resonators, this embodiment can realize a much smaller dielectric laminated filter.

(Embodiment 6)

Figure 17:
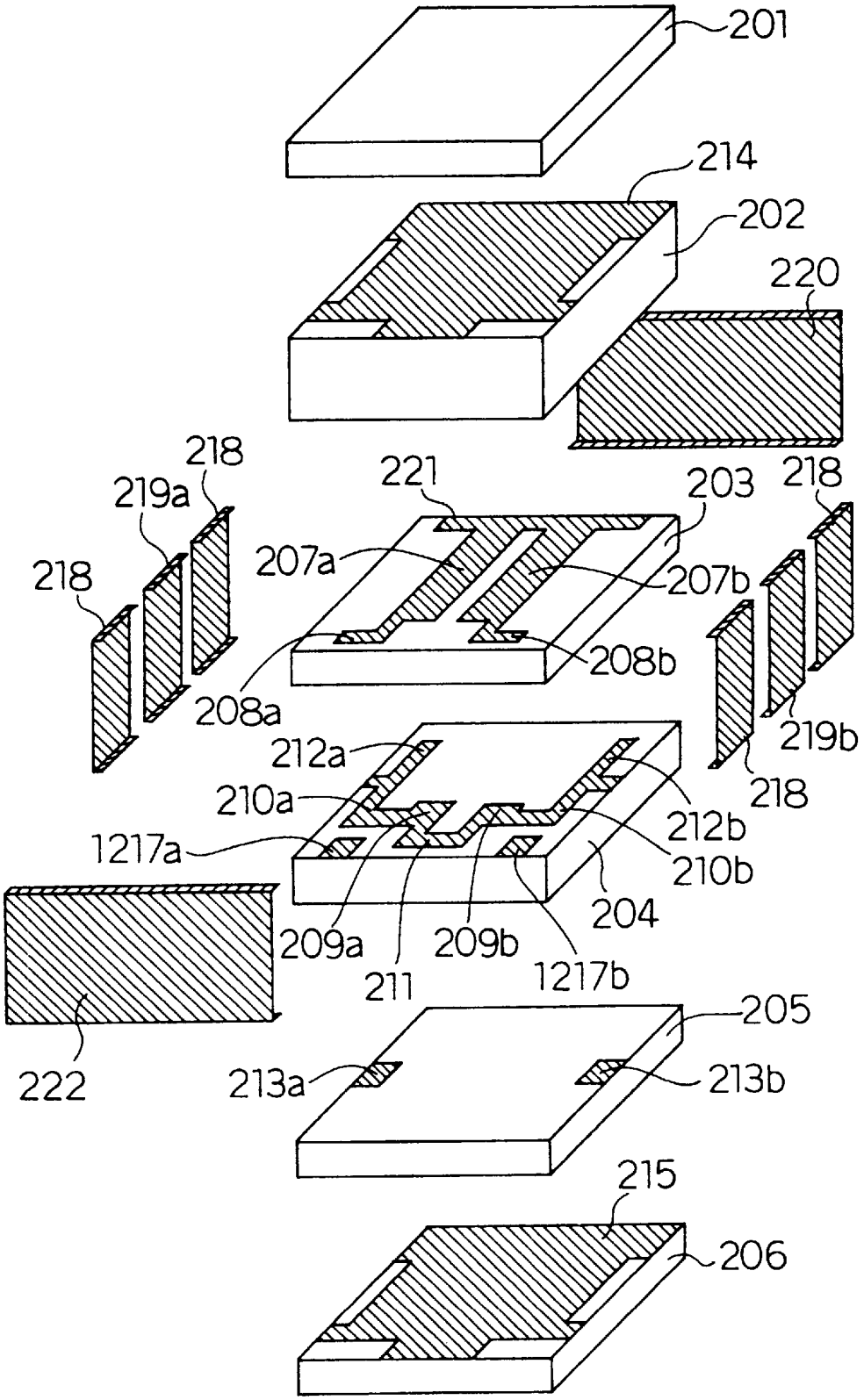
FIG. 17 is an exploded perspective view of a dielectric laminated filter according to a sixth embodiment of this invention.
Figure 18:
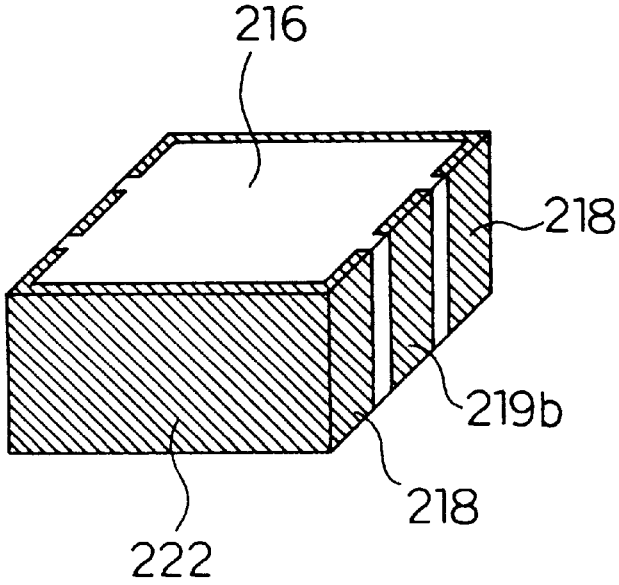
FIG. 18 is a perspective view of the dielectric laminated filter according to the sixth embodiment of this invention.
Figure 19:
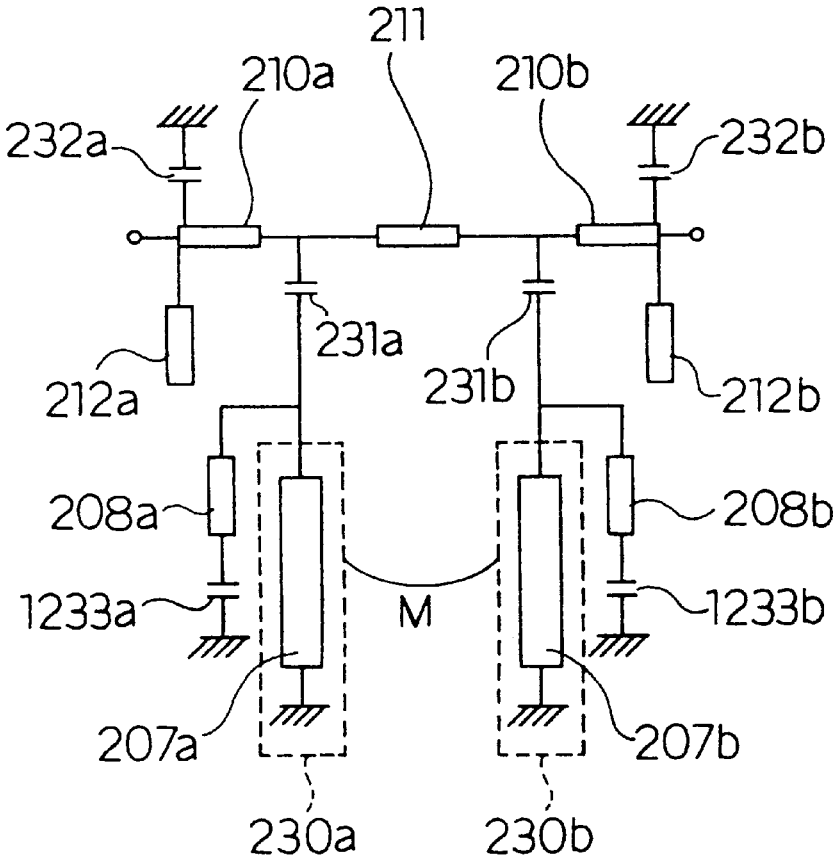
FIG. 19 is an equivalent circuit diagram of the dielectric laminated filter according to the sixth embodiment of this invention.

FIG. 17 is an exploded perspective view of a dielectric laminated filter according to this embodiment of the invention. FIG. 18 is a perspective view of a dielectric body according to this embodiment. FIG. 19 shows an equivalent circuit of the dielectric laminated filter according to this embodiment.

In FIGS. 17 and 18, 201, 202, 203, 204, 205, and 206 are dielectric sheets. These dielectric sheets comprise dielectric ceramic of the same material that have been formed into green sheets and that are sintered at low temperatures ($\epsilon r=7$ to 100).

Reference numerals 207*a* and 207*b* denote the first strip line electrodes formed on the top surface of the dielectric sheet 203 in parallel. Reference numerals 208*a* and 208*b* indicate second strip line electrodes formed so as to be narrower than the first strip lines 207*a* and 207*b*. The second strip line electrodes are each formed on the top surface of the dielectric sheet 203 to connect one ends of the first strip lines 207*a* and 207*b* (corresponding to a plurality of resonance electrodes according to this invention) to one ends of the second strip lines 208*a* and 208*b* (corresponding to a plurality of line electrodes according to claim 15 of this invention), respectively. Reference numeral 221 is a ground pattern electrode one end of which is connected to the other ends of the first strip lines 207*a* and 207*b*. The first strip line electrodes 207*a* and 207*b* correspond to a plurality of resonance electrodes that are electromagnetically coupled together according to this invention.

Furthermore, 209*a* and 209*b* are notch capacity electrodes, 210*a* and 210*b* are I/O line electrodes, 211 is a coupling line electrode, and 212*a* and 212*b* are open stub electrodes. In addition, 1217*a* and 1217*b* are ground capacity electrodes formed on the top surface of the dielectric sheet 204.

The notch capacity electrodes 209*a* and 209*b* are formed opposite to the first strip line electrodes 207*a* and 207*b*. The ground capacity electrodes 1217*a* and 1217*b* are formed opposite to the second strip line electrodes 208*a* and 208*b*. The I/O line electrodes 210*a* and 210*b*, the open stub electrodes 212*a* and 212*b*, and the coupling line electrode 211 are formed so as not to be opposed to the first or the second strip line electrodes 207*a* and 207*b* or 208*a* and

208*b*. One end of the I/O line electrode 210*a* and one end of the coupling line electrode 211 are connected to the notch capacity electrode 209*a,* while one end of the I/O line electrode 210*b* and the other end of the coupling line electrode 211 are connected to the notch capacity electrode 209*b*. In addition, the open stub electrodes 212*a* and 212*b* are each connected to the I/O line electrodes 210*a* and 210*b* in parallel, respectively. The capacity electrodes opposed to the open ends of the strip lines via the dielectric sheet according to this invention correspond to the notch capacity electrodes 209*a* and 209*b*.

Reference numerals 213*a* and 213*b* are matching capacity electrodes formed on the top surface of the dielectric sheet 205. Reference numerals 214 and 215 are shield electrodes formed on the top surface of the dielectric sheets 202 and 206, respectively.

These inner electrodes have their electrode patterns printed using metallic paste such as silver, copper, or gold having a high conductivity.

Reference numeral 216 designates a laminated body formed by laminating the dielectric sheets 206, 205, 204, 203, 202, and 201 in this order, pressing them, and simultaneously sintering the dielectric sheets and the inner electrodes at 960° C., which is the melting point of silver, or lower.

The formation of the outer electrodes is described below.

Reference numeral 222 denotes a ground electrode formed all over one of the outer circumferential sides of the laminated body 216 and connected to the shield electrodes 214 and 215 and frequency adjustment electrodes 217*a* and 217*b*. Reference numeral 218 indicates a side shield electrode formed at both ends of two opposite outer circumferential sides of the laminated body 216 and connected to the shield electrodes 214 and 215. Reference numerals 219*a* and 219*b* indicate I/O electrodes formed on the two opposite outer circumferential sides of the laminated body 216. The I/O electrode 219*a* is connected to the other end of the I/O line electrode 210*a* and a matching capacity electrode 213*a,* while the I/O electrode 219*b* is connected to the other end of the I/O line electrode 210*b* and a matching capacity electrode 213*b*. Reference numeral 220 designates a ground electrode formed on one outer circumferential side of the laminated body 216, connected to the shield electrodes 214 and 215, and also connected to the other ends of the first strip line electrodes 207*a* and 207*b* via the ground pattern electrode 221.

These outer electrodes are formed by printing or plating electrode patterns using metallic paste such as silver, copper, or gold having a high conductivity, which is different from the inner electrode.

The dielectric laminated filter of this configuration is further described with reference to FIGS. 17, 18, and 19.

The other ends of the first strip line electrodes 207*a* and 207*b* are grounded via the ground pattern electrode 221 and the ground electrode 220 to constitute tip shorting strip line resonators 230*a* and 230*b* that use one ends of the first strip line electrodes 207*a* and 207*b* as open ends, thereby causing the electromagnetic coupling M to be generated between the tip shorting strip line resonators 230*a* and 230*b* and to act as a coupling element. In addition, the notch capacity electrodes 209*a* and 209*b* are formed opposite to the first strip line electrodes 207*a* and 207*b* to constitute notch capacity elements 231*a* and 231*b*. The I/O line electrodes 210*a* and 210*b* and the coupling line electrode 211 act as coupling elements for distributed constant lines. Thus, by connecting the I/O line electrodes 210*a* and 210*b* and the coupling line electrode 211 to the notch capacity electrodes 209*a* and 209*b* as described above, the tip shorting strip line resonators 230*a* and 230*b* are connected in parallel via the notch capacity elements 231*a* and 231*b* to constitute a band elimination filter with the I/O electrodes 219*a* and 219*b* as I/O terminals.

In addition, matching capacity elements 232*a* and 232*b* are provided between the matching capacity electrodes 213*a* and 213*b* and the shield electrode 215 via the dielectric sheet 205 to match the impedance of the I/O terminals (see FIG. 19).

Furthermore, ground capacity elements 1233*a* and 1233*b* are provided between the ground capacity electrodes 1217*a* and 1217*b* and the second strip line electrodes 208*a* and 208*b,* respectively.

The ground capacity elements 1233*a* and 1233*b* are connected to one ends of the first strip line electrodes 207*a* and 207*b* via the second strip line electrodes 208*a* and 208*b,* respectively, to allow the resonance frequency to be adjusted. The open stub electrodes 212*a* and 212*b* are connected to the I/O line electrodes 210*a* and 210*b,* respectively, in parallel to reduce the wavelength of the open stubs to one-fourth in order to form attenuation poles for high-order harmonic frequencies.

As described above, since this embodiment can reduce the unwanted electromagnetic coupling between the first strip line electrodes 207*a* and 207*b* and the I/O line electrodes 210*a* and 210*b* and between the first strip line electrodes 207*a* and 207*b* and the coupling line electrode 211 by forming the I/O line electrodes 210*a* and 210*b,* the open stub electrodes 212*a* and 212*b,* and the coupling line electrode 211 in positions such that they are not opposed to the first and the second strip line electrodes 207*a* and 207*b,* and 208*a* and 208*b*.

The dielectric laminated filter according to this embodiment can further reduce the electromagnetic coupling between the strip lines and the coupling element line (meaning the coupling line electrode and the I/O line electrodes) while maintaining a required unloaded Q for the filter characteristics.

The reason is described below. It is known that the electromagnetic coupling can be maximized by reducing the line width of the strip line electrodes 207*a* and 207*b* to reduce the area of each strip line electrode. The unloaded Q is degraded as the line width of the strip line electrodes becomes smaller. On the contrary, it is known that the unloaded Q is improved as the laminated portion sandwiched by the shield electrodes becomes thicker.

Thus, in the above structure, even if the line width of the strip line electrodes 207*a* and 207*b* is reduced, the total thickness of the laminated portions 202 to 205 sandwiched by the two shield electrodes 214 and 215 is large enough to minimize the unwanted electromagnetic coupling without significantly reducing the unloaded Q, that is, while maintaining a required unloaded Q for the filter characteristics.

In addition, the electromagnetic coupling between the resonators and the coupling line electrode 211 can be appropriately combined to achieve an elliptic function characteristic as described above in order to obtain a steeper attenuation characteristic curve compared to a conventional Chebychev's characteristic 404 that does not uses the electromagnetic coupling M between the resonators, as shown in the graph of the FIG. 23. That is, insertion losses can be reduced in a desired attenuation band 401 and a pass band 402 used to obtain an amount of attenuation. Consequently, the attenuation band 401 can be expanded without providing a multi-stage filter, thereby reducing the size of the filter and losses (increasing the performance).

Furthermore, the electromagnetic coupling M between the resonators and the coupling line electrode 211 can be appropriately combined as described above to provide a coupling element with an impedance and a wavelength that cannot be achieved only by the coupling line electrode 211 due to a geometrical constraint.

In addition, the matching capacity elements 232*a* and 232*b* can be provided to match the impedance of the I/O terminals of even an I/O line the length of which has been reduced by reducing the area in which the strip lines are not opposed to the coupling element line.

Since one ends (open ends) of the first strip line electrodes 207*a* and 207*b*, and the second strip line electrode 208*a* and 208*b* constituting the ground capacity elements 1233*a* and 1233*b*, respectively, are connected to the open ends of the tip shorting strip line resonators 230*a* and 230*b*, respectively, a field distribution dominates both electrodes. Furthermore, the width of the second strip line electrodes 208*a* and 208*b* can be reduced below that of the first strip line electrodes 207*a* and 207*b* to reduce the field strength. The interval between the second strip line electrodes 208*a* and 208*b* can also be increased to reduce the field coupling between these electrodes 208*a* and 208*b* down to a negligible magnitude.

Thus, a frequency adjustment mechanism (a loading capacity) can be configured easily without complicating the design, thereby providing a good band elimination filter characteristic.

As a result, by eliminating the unwanted electromagnetic coupling and using the electromagnetic coupling between the resonators, the degree of freedom in design can be increased to increase the dielectric constant of the dielectric sheets in order to reduce the size of the resonators and the coupling line, thereby reducing the size of the dielectric laminated filter and improving the performance.

In addition, the open stub electrodes 212*a* and 212*b* can be connected to the I/O line electrodes 210*a* and 210*b*, respectively, in parallel to reduce the wavelength of the open stubs to one-fourth in order to form attenuation poles for high-order harmonic frequencies, as described in the fifth embodiment. These attenuation poles are effective in attenuating high-order harmonic bands and can be formed without affecting the characteristics of the fundamental pass band or the attenuation band.

Thus, since high-order harmonic bands can be attenuated without adding an LPF, the size and losses of this multifunctional filter can be reduced.

In addition, the reliability and performance can be improved by making the outer and the inner electrodes of different electrode materials. For example, assume that silver paste is used as a material of the inner and the outer electrodes. Since the inner electrodes are configured to be sandwiched between dielectric pastes, silver paste with a low adhesion strength and a high conductivity and without glass frits can be used for these electrodes to improve the unloaded Q of the resonators and thus the performance. Silver paste with a low conductivity, a high adhesion strength, and glass frits can be used for the outer electrodes to improve the reliability of the I/O terminals.

(Embodiment 7)

A seventh embodiment of this invention is described below with reference to the drawings.

Figure 20:
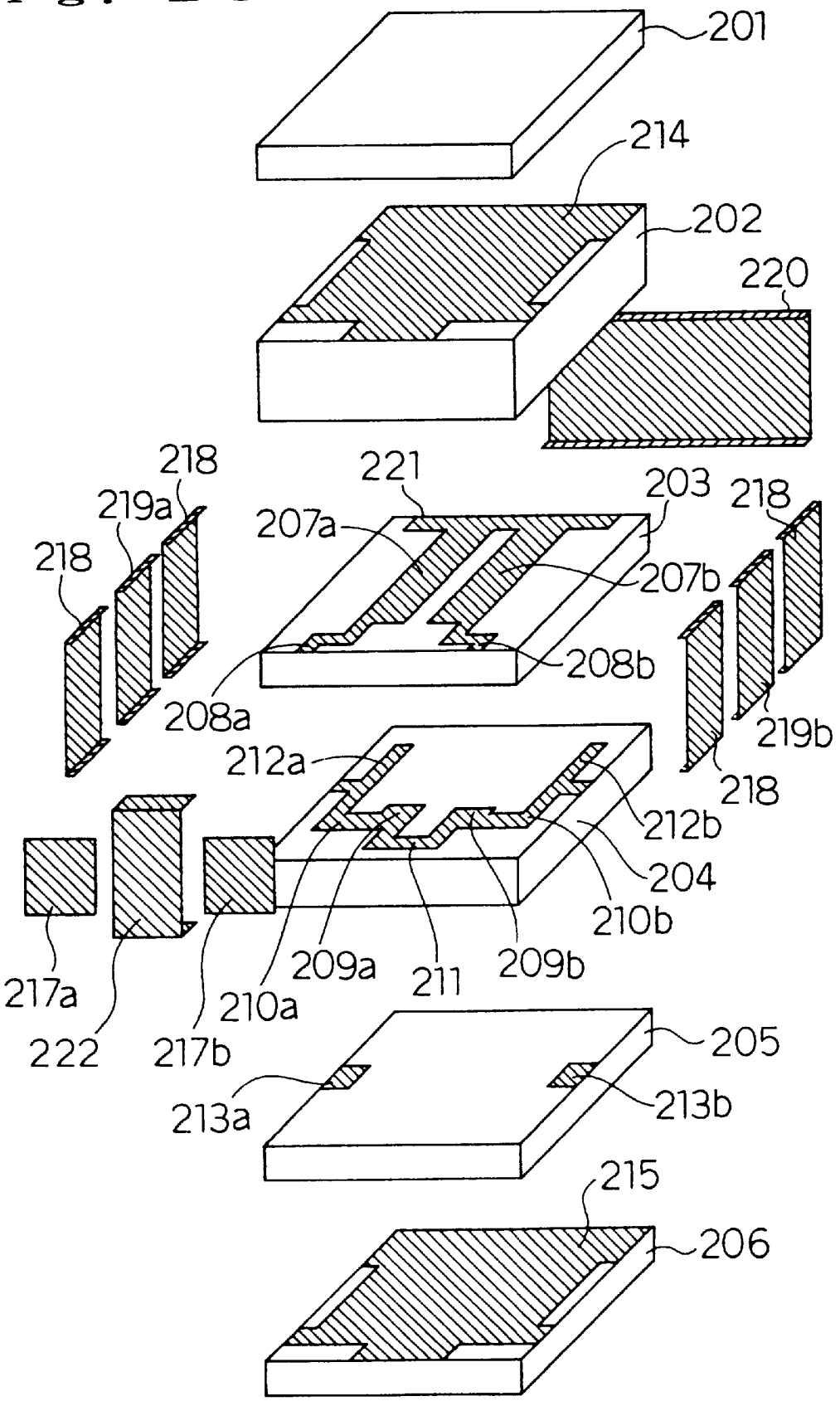
FIG. 20 is an exploded perspective view of a dielectric laminated filter according to a seventh embodiment of this invention.
Figure 21:
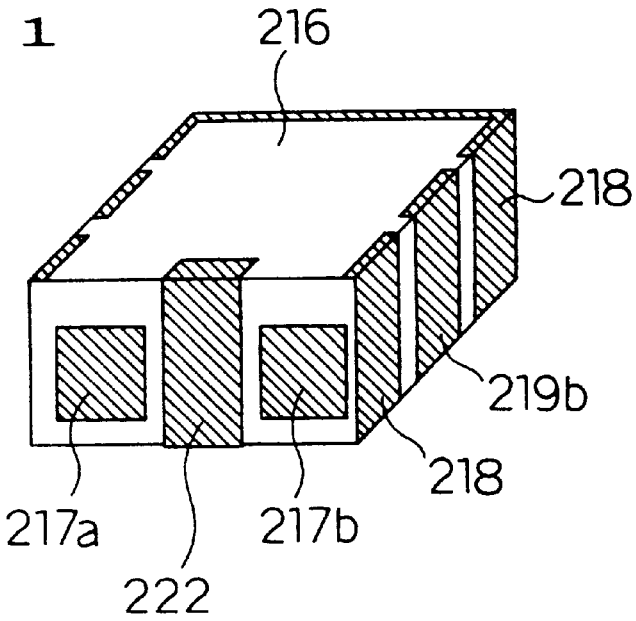
FIG. 21 is a perspective view of the dielectric laminated filter according to the seventh embodiment of this invention.
Figure 22:
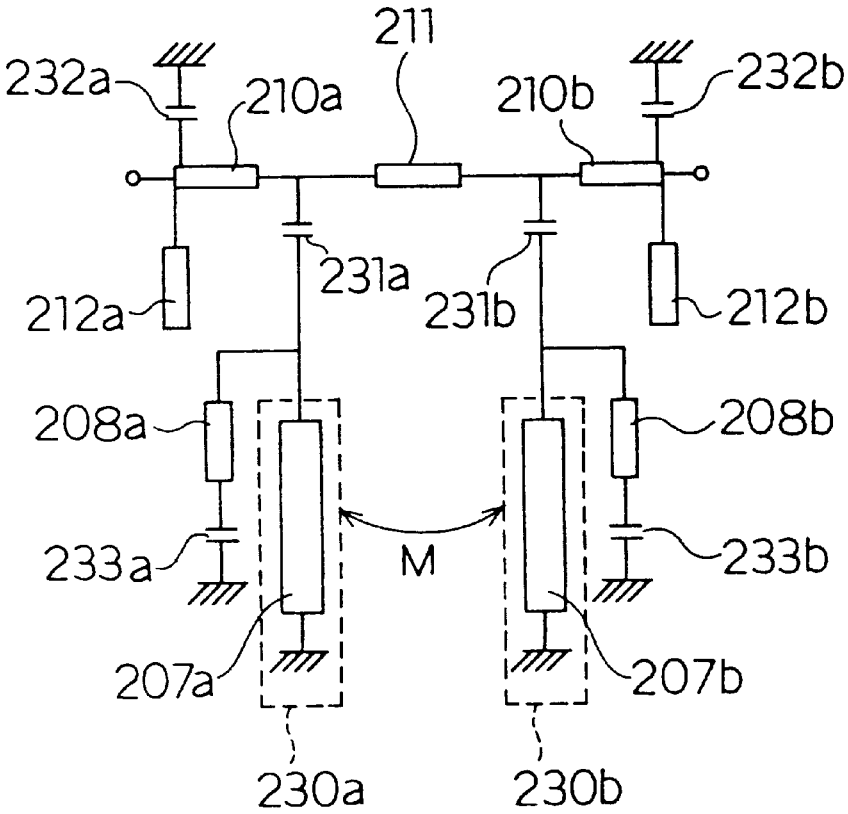
FIG. 22 is an equivalent circuit diagram of the dielectric laminated filter according to the seventh embodiment of this invention.

FIG. 20 is an exploded perspective view of a dielectric laminated filter according to this embodiment of the invention. FIG. 21 is a perspective view of a laminated body according to this embodiment. FIG. 22 shows an equivalent circuit of the dielectric laminated filter according to this embodiment.

As shown in FIGS. 20 and 21, the structure of this dielectric laminated filter is the same as that shown in the sixth embodiment except for the following points.

The other ends of the second strip lines 208*a* and 208*b* (corresponding to a plurality of line electrodes according to claim 14 of this invention) are each formed to extend up to one side of the dielectric sheet 203, the frequency adjustment electrodes 217*a* and 217*b* are formed as the outer electrodes on an outer circumferential side of the laminated body 216 and connected to the other ends of the second strip line electrodes 208*a* and 208*b*, respectively.

Furthermore, frequency adjustment capacity elements 233*a* and 233*b* are provided between the frequency adjustment electrodes 217*a* and 217*b* and the ground electrode 222, respectively.

The ground capacity electrodes 1217*a* and 1217*b* described in the sixth embodiment and the frequency adjustment electrodes 217*a* and 217*b* according to this embodiment have the same functions in that all of them can adjust the resonance frequency of the tip shorting strip line resonators 230*a* and 230*b*. The electrodes 217*a* and 217*b*, however, can adjust the resonance frequency after the lamination of each dielectric laminated sheet, whereas the electrodes 1217*a* and 1217*b* can perform the same operation only prior to lamination.

As described above, this embodiment not only has the same operation and features as the sixth embodiment but can also trim the frequency adjustment electrodes 217*a* and 217*b* configured as the outer electrodes in order to reduce the frequency adjustment capacity elements 233*a* and 233*b*, thereby enabling only the resonance frequency of the tip shorting strip line resonators 230*a* and 230*b* to be adjusted.

Since the dispersion of dielectric sheets and electrode patterns can be absorbed and the resonance frequency can be adjusted without affecting a coupling element such as the electromagnetic coupling M between the resonators, the attenuation characteristic of the band elimination filter can be adjusted simply and independently.

This embodiment can thus realize a dielectric laminated filter with a better yield than the sixth embodiment.

Figure 24:
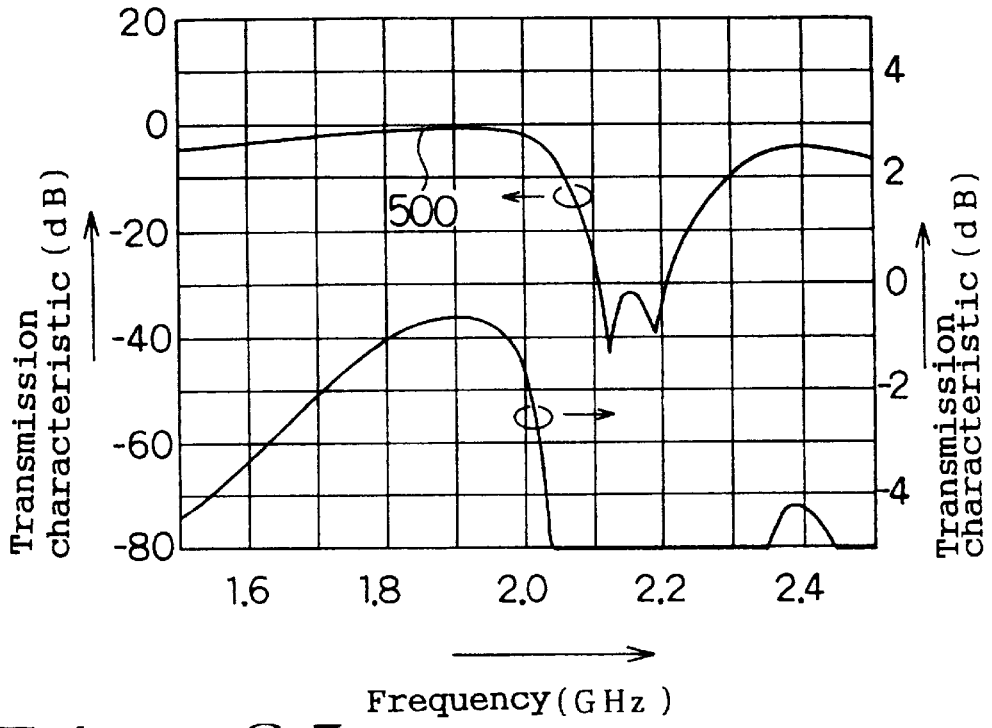
FIG. 24 is a graph (narrow span) showing the frequency characteristic of a dielectric laminated filter experimentally manufactured in the seventh embodiment.
Figure 25:
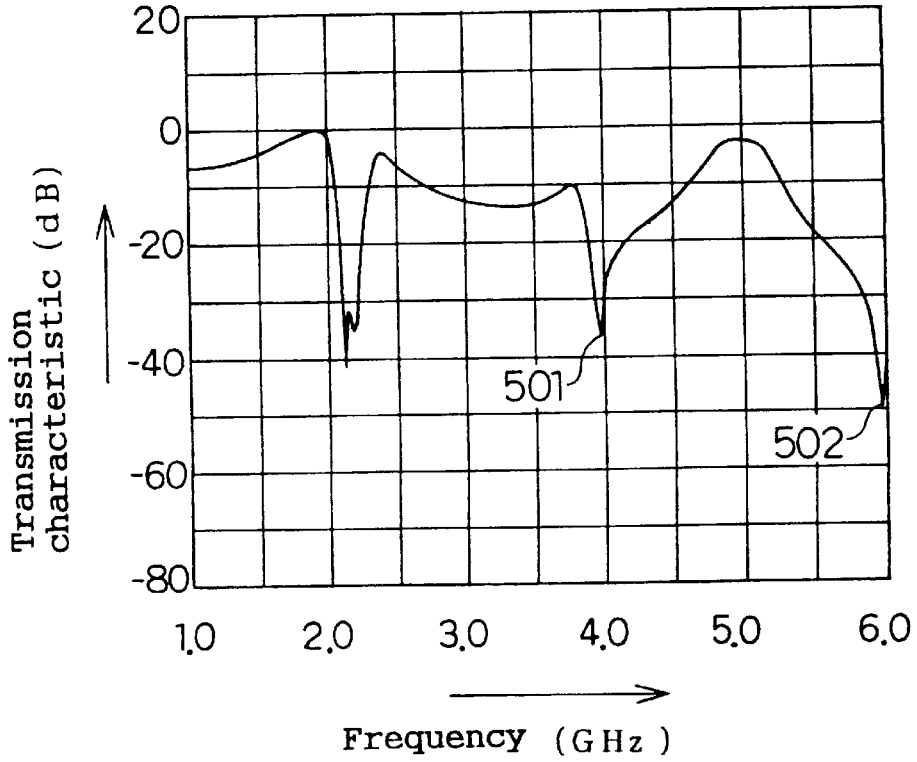
FIG. 25 is a graph (wide span) showing the frequency characteristic of the dielectric laminated filter experimentally manufactured in the seventh embodiment.

FIGS. 24 (narrow span) and 25 (wide span) are graphs showing the frequency characteristic of a dielectric laminated filter experimentally manufactured according to this embodiment. Dielectric sheets with a dielectric constant $\epsilon r=58$ and the laminated body 216 had a size of 4.5×3.2×2.0 mm. The electromagnetic coupling between the resonators and the coupling line electrode 211 were appropriately combined as described above to achieve an elliptic function characteristic 500 shown in FIG. 23. The open stub electrodes 212*a* and 212*b* were constructed to provide an attenuation pole 501 for a second-order harmonic band and an attenuation pole 502 for a third-order harmonic band.

The above dielectric laminated filter can be applied to a communication apparatus to reduce its size and to improve its performance.

The dielectric laminated filter according to this embodiment, for example, allows the height of parts to be reduced compared to a coaxial resonator type, thereby enabling the three-dimensional space of the communication apparatus to reduce its size. In addition, by providing a band elimination filter to attenuate only undesired bands, losses in pass bands can be reduced compared to a band pass filter to reduce the power consumption of an amplifier, thereby increasing the lifetime expectancy of batteries or reducing their capacity, that is, their size.

The communication apparatus comprises, for example, a receipt means for receiving a radio signal from a source; a signal processing means comprising the dielectric laminated filter described in any of the above embodiments to extract a predetermined portion from the received signal and processing it; an output means for outputting the processed signal to a speaker, and a signalling means for issuing a signal to the source. Of course, the signalling means can be emitted from the communication apparatus.

The above embodiments can provide a small high-performance dielectric laminated filter that can be designed easily and that enables the resonance frequency of the filter and the electromagnetic coupling between resonators to be adjusted during a manufacturing process.

Although the above embodiments have been described in conjunction with the two strip lines formed on the same dielectric sheet, this invention is not limited to this aspect and three strip lines may be formed thereon. In this case, two coupling line electrodes are required and connected in series.

Although the embodiments 6 and 7 have been described in conjunction with the strip line electrodes formed on the same plane, that is, on the same layer, this invention is not limited to this aspect and the first strip line electrodes 207*a* and 207*b* maybe formed on different layers. For example, the second strip line electrodes 208*a* and 208*b* can also be formed on different layers.

What is claimed is:

1. A dielectric laminated filter comprising:

a first dielectric laminated block in which a plurality of dielectric sheets are laminated;

a plurality of first resonance electrodes formed over an inner layer of said first dielectric laminated block;

a second dielectric laminated block in which a plurality of dielectric sheets are laminated;

a plurality of second resonance electrodes formed on a first inner layer of said second dielectric laminated block;

a coupling element formed on a second inner layer of said second dielectric laminated block;

input and output electrodes respectively formed at first and second outer surfaces of said second inner layer;

a plurality of notch capacity electrodes formed on said second inner layer coupled between respective input and output electrodes and respective ends of said coupling element, each of said notch capacity electrodes positioned below each of said second resonance electrodes to form a coupling capacitor;

a first shield electrode formed between said first dielectric laminated block and said second dielectric laminated block;

a plurality of third resonance electrodes formed on a third outer surface of said first and second dielectric laminated blocks to connect one end of each of said first resonance electrodes to one end of each of said second resonance electrodes;

a second shield electrode formed above a top surface of said first shield electrode;

a third shield electrode formed below a bottom surface of said first shield electrode; and a ground electrode formed on a fourth outer surface to connect said first, second, and third shield electrodes together.

2. A dielectric laminated filter according to claim 1 further including a plurality of electrodes that are each formed on either of said first and second outer surfaces.

3. A dielectric laminated filter according to claim 1 wherein said second and third shield electrodes are formed respectively over a top outer surface of said first dielectric laminated block and a bottom surface of said second dielectric laminated block.

4. A dielectric laminated filter according to claim 1 including an outer dielectric sheet laminated on an outer surface of said second shield electrode, wherein one end of said third resonance electrode extends up to the top surface of said outer dielectric sheet.

5. A dielectric laminated filter according to claim 1 wherein one of said plurality of second resonance electrodes has a larger width than one of said plurality of first resonance electrodes.

6. A dielectric laminated filter according to claim 1 wherein said first and second dielectric laminated blocks have different thicknesses.

7. A dielectric laminated filter according to claim 1 wherein said first and second dielectric blocks are formed of said dielectric laminated sheets of different dielectric constants.

8. A dielectric laminated filter according to claim 1 including open stubs connected to said coupling element in parallel to attenuate high-order harmonic bands.

9. A dielectric laminated band elimination filter comprising:

a dielectric laminated block in which a plurality of dielectric sheets are laminated;

a plurality of resonance electrodes formed on a first inner layer of said dielectric laminated block;

a coupling line formed on a second inner layer of said dielectric laminated block to connect each of said plurality of resonance electrodes in parallel;

an I/O line formed on the second inner layer on said dielectric laminated block; and a shield electrode disposed between the first and second inner layers separating said plurality of resonance electrodes from said I/O line.

10. A dielectric laminated band elimination filter according to claim 9 wherein said plurality of resonance electrodes are formed on one dielectric sheet and substantially disposed in parallel along a longitudinal direction.

11. A dielectric laminated band elimination filter according to claim 9 wherein said parallel connection is made via capacity elements.

12. A dielectric laminated band elimination filter according to claim 9, wherein said I/O line and said coupling line are connected in series.

13. A dielectric laminated filter according to claim 9 including a plurality of line electrodes with a smaller width than said plurality of resonance electrodes formed on an inner layer of said dielectric laminated block, wherein one end of each of said resonance electrodes is connected to one end of each of said line electrodes and wherein the other end of said line electrode is connected to an adjustment electrode formed outside said dielectric laminated block.

14. A dielectric laminated filter according to claim 9 including a plurality of line electrodes with a smaller width than said plurality of resonance electrodes formed on an inner layer of said dielectric laminated block, wherein one end of each of said resonance electrodes is connected to one end of each of said line electrodes and wherein the other end of each of said line electrodes is connected to a ground electrode via a capacity element.

15. A dielectric laminated band elimination filter according to claim 9 including a capacity electrode formed on the second inner layer of said dielectric laminated block and opposed to an open end of one of said plurality of resonance electrodes via said dielectric laminated block, wherein said capacity electrode and said coupling line are connected in series.

16. A dielectric laminated filter according to claim 1, wherein the material of the first and second resonance electrodes is different from that of the third resonance electrodes.

17. A communication apparatus for use with a signal, said apparatus comprising:

receipt means for receiving the signal;

signal processing means for processing the signal, said signal processing means including a dielectric laminated filter comprising a first dielectric laminated block in which a plurality of dielectric sheets are laminated, a plurality of first resonance electrodes formed over an inner layer of said first dielectric laminated block, a second dielectric laminated block in which a plurality of dielectric sheets are laminated, a plurality of second resonance electrodes formed on a first inner layer of said second dielectric laminated block, a coupling element formed on a second inner layer of said second dielectric laminated block, input and output electrodes respectively formed at first and second outer surfaces of said second inner layer, a plurality of notch capacity electrodes formed on said second inner layer coupled between respective input and output electrodes and respective ends of said coupling element, each of said notch capacity electrodes positioned below each of said second resonance electrodes to form a coupling capacitor, a first shield electrode formed between said first dielectric laminated block and said second dielectric laminated block, a plurality of third resonance electrodes formed on a third outer surface of said first and second dielectric laminated blocks to connect one end of each of said first resonance electrodes to one end of each of said second resonance electrodes, a second shield electrode formed above a top surface of said first shield electrode, a third shield electrode formed below a bottom surface of said first shield electrode, and a ground electrode formed on a fourth outer surface to connect said first, second, and third shield electrodes together; and output means for outputting said processed signal.

18. A dielectric laminated filter according to claim 1, wherein said coupling element is formed substantially at a center of said second inner layer, said input and output electrodes are respectively formed at opposite first and second outer surfaces, and said plurality of notch capacity electrodes are two in number.

* * * * *